United States Patent [19]

Luartes et al.

[11] Patent Number: 4,462,708

[45] Date of Patent: Jul. 31, 1984

[54] AUTOMATED TAPE LETTERING MACHINE

[75] Inventors: Cleto R. Luartes, Burnsville; William H. Powell, Jr., Stillwater, both of Minn.

[73] Assignee: Kroy Inc., Scottsdale, Ariz.

[21] Appl. No.: 252,699

[22] Filed: Apr. 8, 1981

[51] Int. Cl.[3] ..... B41J 1/30

[52] U.S. Cl. ..... 400/304; 400/52; 400/63; 400/130; 400/154.5; 400/479

[58] Field of Search ..... 400/4, 63, 130, 154.5, 400/486–489, 304, 712, 50, 14, 479, 52

[56] References Cited

U.S. PATENT DOCUMENTS

| | | | |
|---|---|---|---|
| 3,236,352 | 2/1966 | Schacht | 400/611 X |
| 3,712,443 | 1/1973 | Mathews | 400/304 |
| 3,823,389 | 7/1974 | Heitman et al. | 400/63 X |
| 3,834,507 | 9/1974 | Bradshaw | 400/134.6 |
| 3,912,064 | 10/1975 | Bluem et al. | 400/134.6 |
| 3,913,721 | 10/1975 | Koplow et al. | 400/63 |
| 3,981,383 | 9/1976 | Bittner et al. | 400/712 X |
| 4,015,700 | 4/1977 | Paque | 400/617 |
| 4,050,565 | 10/1977 | Heider et al. | 400/130 |
| 4,108,556 | 8/1978 | Connoy | 400/654 X |
| 4,225,249 | 10/1980 | Kettler et al. | 400/304 X |
| 4,243,333 | 1/1981 | Bradshaw et al. | 400/158 |

FOREIGN PATENT DOCUMENTS

| | | | |
|---|---|---|---|
| 0024620 | 3/1981 | European Pat. Off. | 400/711 |
| 2922006 | 12/1979 | Fed. Rep. of Germany | 400/486 |

OTHER PUBLICATIONS

IBM Technical Disclosure Bulletin, vol. 19, No. 12, 5-'77, pp. 4691–4692, Written by S. F. Kambic.

*Primary Examiner*—Edgar S. Burr
*Assistant Examiner*—John A. Weresh
*Attorney, Agent, or Firm*—Dorsey & Whitney

[57] ABSTRACT

An improved dry lettering printing machine of the type having a printing station, a rotatable disc or type font having embossed characters on the disc and a means for causing the machine to execute a print cycle which includes providing a color carrying ribbon and image carrying tape at the print station, precisely aligning a selected raised character on the disc for printing, exerting a printing force at the printing station, and reciprocating the tape cartridge to advance the tape and ribbon to print the next character at the printing station. The improvement includes an input keyboard for typing the information which is to appear on the tape interfaced with the printing machine with a programmed microcomputer which stores the input data and, with control signals, sequentially causes the printing machine to print a tape according to the information typed on the keyboard. The improvement further includes a means for electromechanically rotating the disc or type font in either a clockwise or counterclockwise direction, whichever is shorter, to position the next character for printing which enhances the speed and automatic operation of the improved machine. A number of function keys and indicators are also provided on the keyboard to further enhance the speed and ease of operation of the printing machine.

36 Claims, 20 Drawing Figures
Microfiche Appendix Included
(2 Microfiche, 85 Pages)

A
B
C
D
E
F
G
H
I
J
K
L
M
N
O
P
Q
R
S
T
U
V
W
X
Y
Z
A'
B'
X'
C'
D'
E'
F'
G'
H'
PU
+V
Vcc
107
108
109
110
111
120
141
161
AB9
AB8
AB7
AB6
AB5
AB4
AB3
AB2
AB1
AB0
AB11
AB10
DB7
DB6
DB5
DB4
DB3
DB2
DB1
DB0
CE
WE
DE
RD
WR
STB
CLK
CSO
CSI
MI
IORQ
INT
REG
IEI
IEO
MT
I/O
RES
HOME
CCW
CW
CU
CD
PL
R
O1
O0

A further object of the present invention is to provide an improved lettering apparatus and composing system having the capability to provide a plurality of printed tapes having consistent accuracy and quality.

These and other objects of the present invention will become apparent with reference to the drawings, the description of the preferred embodiment and the appended claims.

DESCRIPTION OF THE DRAWINGS

FIG. 4, comprising

DESCRIPTION OF THE PREFERRED EMBODIMENT

Figure 4B:
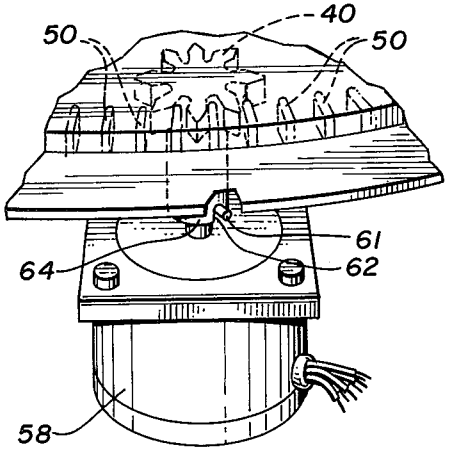
FIGS. 4*a*–4*c*, shows detail views of the modified printing apparatus taken with the type disc label removed to show the operational detail of the preferred stepping gear and how it engages the type disc or font element to rotate the disc for alignment at the printing station.

U.S. Pat. No. 4,243,333, issued Jan. 6, 1981, discloses and teaches a dry lettering printing apparatus 10 comprising a printing station 14, a means for providing a color carrying ribbon and image carrying tape 16 at the printing station 14, a means for providing a raised character in printing alignment at the printing station 14, a force generating means for exerting a printing force at the printing station 14, and means for advancing the ribbon and tape 16 into printing alignment at the printing station 14. As such, the invention of that patent provides an improved printing apparatus 10 which manually produces high quality lettered tape 16 suitable for use on office copiers, with offset printing, silk screening, stencil duplication, diazo reproductions, overhead transparencies, slides, labeling, and with microfilm. With the use of interchangeable discs 18 the apparatus of that patent is capable of producing many varying lettering styles, symbols, as well as domestic and foreign languages.

The present invention combines with the apparatus of U.S. Pat. No. 4,243,333, a processing means 101 for receiving input data to be printed on the tape 16 and for supplying control signals to the printing apparatus 10 to cause the printing apparatus 10 to print the input data on the tape 16. The preferred processing means is a programmable digital processing means 101 for storing input data to be printed on the tape and control information, the control information being in the form of a stored program for directing control functions to be performed and for supplying control signals to the printing apparatus 10 as a function of the control information. The improvement further comprises means 200 connected to the processing means 100 for entering input data to be printed on the tape 16 which in the preferred embodiment is an input keyboard 200 but could also be a digital computer or other input means.

As indicated in the referenced patent, the preferred means for providing a raised character for printing comprises a type disc or font 18 and the improvement of this invention comprises a character positioning motor means comprising a stepper motor 58 and associated gear 40 for positioning the type font to provide a selected character at the print station, but any motor with motor control means could be utilized. The stepper motor 58 is preferably controlled by character positioning motor control means such as a stepper motor translator circuit 140 responsive to control signals from the programmable digital processing means 101. The improvement further comprises print motor control means for causing the print cycle to occur in response to control signals from the programmable controller 100.

The combination of features which make up the combination of the instant inventions is preferably controlled by a stored program which functions in the manner described in connection with FIG. 13, although those skilled in the art will recognize that software functions can be accomplished by equivalent hardware. The combination of elements which forms the present invention is thus capable of producing, consistently and repeatably, high quality lettered tape at a rate substantially faster than has been accomplished in the past.

Figure 1:
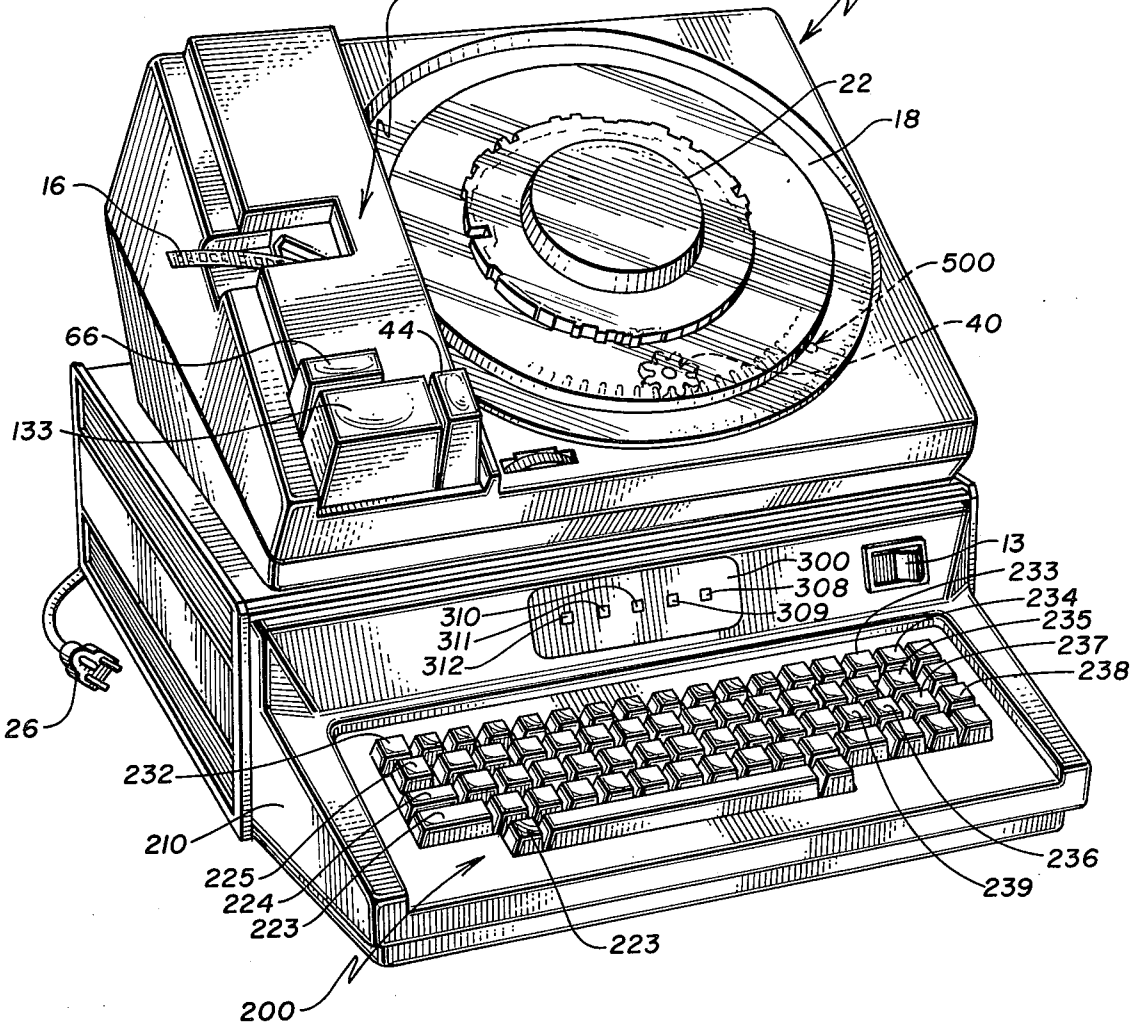
FIG. 1 is a perspective view of the combination of our invention showing the automated printing apparatus consisting of two modules, a keyboard assembly for data input and a modified printing apparatus from which the imprinted tape is issued.

As shown in FIG. 1, user operable elements of the combination include the input keyboard 200 onto which is typed operating functions and the messages which the operator wishes to appear on the tape 16. Since a typist is likely to type much faster than the printing apparatus can produce printed tape 16, a one hundred twenty-eight character buffer 107' utilizing assigned memory locations in a RAM 107 is included as part of the processing unit 100 which holds and retains the input data while the printing apparatus 10 is printing the tape 16. If

AUTOMATED TAPE LETTERING MACHINE

A microfiche appendix comprising two microfiche and having eighty-five total frames forms a part of this specification by reference hereto.

BACKGROUND OF THE INVENTION

The present invention relates generally to printing apparatus or composing systems and more particularly to an improved printing apparatus or composing system of the type involving the use of a pressure process to transfer dry film impressions onto an image carrying tape. Such apparatus or system includes a printing station, a printing force generating means, a tape and associated carbon ribbon, a type disc or font element with raised characters positionable in printing alignment with the printing stations, and means for advancing the tape and ribbon with respect to the printing station. This type of apparatus or composing system has particular application in the printing of relatively large characters for use in preparing lettering for engineering drawings, flip charts, overhead transparencies, posters, newspaper headlines, advertising brochures and the like. These characters are generally larger than characters produced by most typewriters or other more conventional means.

In dry lettering printing processes a high pressure is utilized to transfer dry carbon or other ink or color material from a ribbon onto an image carrying tape. A type disc or font element having raised surfaces corresponding to the particular image desired to be printed is commonly used in such a process. Successful prior art machines and apparatus used by those employing dry lettering processes are shown and described in U.S. Pat. Nos. 3,834,507; 3,912,064; 4,015,700; 4,108,556 and in U.S. Pat. No. 4,243,333 issued Jan. 6, 1981. While each of these prior art machines has been capable of accurately generating high quality printing and lettering results, there is a need for a higher speed printing apparatus which maintains consistency in accuracy, quality and positioning, thus enabling users to produce display quality headlining in-house at a much higher rate than can be produced manually, thereby reducing the need for a large number of such printing machines or systems and, for repetitive printing, to enable the user to convey the information desired to be printed and the number of copies to be printed and obtain from that information the desired numbers of copies each of which is produced with the same high degree of accuracy and quality.

In an apparatus or system of the type described the operator manually moved the font to the character or symbol desired and pressed the print button. Thereafter the character position was precisely aligned by an electromechanical mechanism and a printing pressure was generated to print the character, after which the tape was advanced. While high quality printing was obtained in this manner, the tape could be printed no faster than the manual movement of the operator and accuracy was dependent on the dexterity and attention of the operator. If the operator were less skilled or the operator's attention lagged, accuracy could be affected requiring the manual printing of entirely new tapes.

SUMMARY OF THE INVENTION

The present invention uniquely combines with the prior art printing apparatus a keyboard input, chosen to the extent possible to be compatible with conventional typewriter keyboards, and a programmable data processing means to receive the data input for the purposes of printing, also having data storage capability to optimize the speed of the apparatus and assure ease of operation, both of which are interfaced with input/output control circuitry which also interfaces with the printer so that the input and output devices and the programmable controller are electronically and electrically compatible according to the electrical specifications of each.

The printing apparatus of the present invention employs the improvements of the prior art devices mentioned above, combined with further improvements to which the present invention is directed. These improvements include a stepper motor and rotating gear to control positioning of the type disc or font element and electronic controls and a position sensor to assure that the proper character is selected for alignment prior to printing. The print motor of the typing apparatus is electronically actuated to create the pressure necessary for high quality printing. An electromagnetic solenoid electromechanically controls the positioning of the type on which the image is printed to aesthetically enhance the spacing between certain combinations of letters such as between the letters "A" and "V, " a process known in the graphic arts industry as "kerning."

In addition to the standard keyswitch positions of conventional typewriter keyboards, dedicated keyswitch positions control the operating modes and special functions of the invention, and audible and visual indicators signal the operating condition and state of the machine to the operator. On-off controls and auxiliary circuits and components including power supplies and a cooling fan complete the combination along with the microcomputer timing circuits and software routines necessary to permit the electromechanical elements of the invention to cooperate together.

Overall control and sequencing of operation is assured by a program stored on a ROM (read only memory) which forms part of the microcomputer which is the preferred digital processing means described below.

Accordingly, a primary object of the present invention is to provide an improved lettering apparatus or composing system of the type utilizing a dry lettering process with improved means for optimizing data input and enhancing operation of the apparatus or system.

Another object of the present invention is to provide an improved lettering apparatus or composing system having an improved input means comprising a keyboard input and data processing and storage means.

A further object of the present invention is to provide an improved and faster means for moving or positioning the type disc or font element, which means include a stepper motor and stepper motor controls to electromechanically position the type disc or font element for character alignment prior to printing and a sensor to detect when the type disc is in a predetermined position.

Another object of the present invention is to provide an improved lettering apparatus and composing system having improved and faster means for enhancing the quality of lettering by automatically controlling the spacing between certain combinations of individual printed letters, which means include an electromagnetic solenoid to electromechanically adjust the position of the image carrying tape prior to actuating the printing force.

the operator exceeds the capacity of the multiple character buffer 107' an audible tone will sound to warn the typist to slow down and allow the printing apparatus 10 to catch up.

Printing of the tape 16 is achieved through the use of the printing apparatus 10 which may employ a plurality of discs 18 having various type styles, symbols and sizes of type or symbols, each of which can be used with the present invention. The type disc 18 is rotated with a stepper motor and gear 40 to the selected character, is precisely aligned, the character is printed, and the tape 16 is advanced to receive the next character from the buffer as previously typed on the keyboard 200. By character we mean any letter, number, symbol, word space, punctuation, or other input which can be entered from the keyboard or other data input means.

Figure 2:
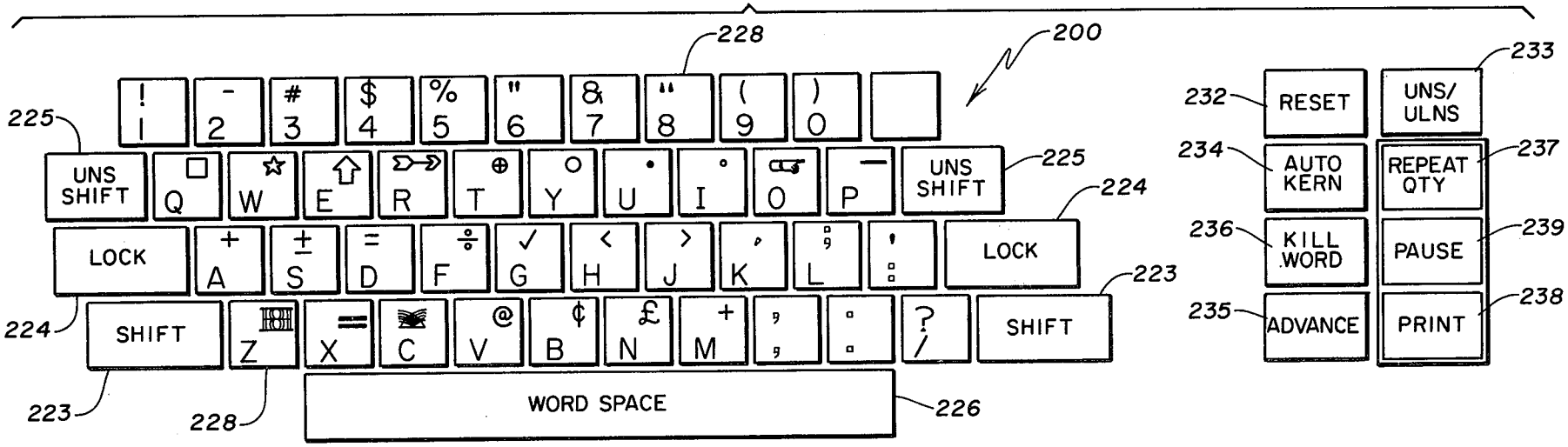
FIG. 2 shows a keyboard having function keys and alphanumeric and symbolic character keys which can be used with the present invention.

FIG. 2 shows a preferred layout for the keyboard 200. It is anticipated that the automated printing apparatus of the present invention will most commonly be used with two primary styles of disc 18 or typefont referred to as "ULNS" (Upper case/Lower case/-Numerals/Symbols) or "UNS" (Upper case/-Numerals/Symbols), which is similar to ULNS except that lower case letters are omitted to provide space for larger type sizes and a number of additional symbols. As shown in FIG. 2 there is a plurality of typing function keys 223–226, and printer function keys 232–239 which enable the operator to control the printing apparatus 10.

In the normal typing area of the keyboard 200 the layout of the keyboard 200 is, to the extent possible, made compatible to the normal keyboard on which a typist would type hard copy or CRT displays. Accordingly, the positioning of the alphanumeric character keys 228 is that conventionally used for a typewriter keyboard so that a typist can conveniently operate the automated printing apparatus although any other arrangement can be conveniently provided.

Nonlocking alphanumeric "SHIFT" keys 223 are conventionally located on each side of the lower row of alphanumeric keys 228 and locking alphanumeric shift "LOCK" keys 224 are located above the nonlocking "SHIFT" keys 223.

In ULNS mode, as indicated by LED 309 on the display 300, and with a ULNS disc 18 on the printing apparatus 10, the characters printed on the tape 16 will correspond generally to a conventional keyboard 200 input, that is, lower case letters, numerals or punctuation upon depression of the keys 229; upper case letters, punctuation or conventional upper row symbols upon depression of the keys 228 in conjunction with a shift key 223 or shift lock keys 223, 224. The "UNS SHIFT" key 225 is designed to facilitate the use of UNS type discs 18. In UNS mode (UNS indicator 310 on) depression of keys 228 will print capital letters, punctuation or numerals. Depression of the keys 228 in conjunction with the shift or shift-lock keys 223, 224, will produce capital letters, upper row punctuation or the conventional symbols along the top row of the keyboard 200. Depression of one of the UNS shift keys 225 and one of the character keys 228 will cause corresponding special symbols to be printed, such as those shown above the characters on the character keys 228 shown in FIG. 2. The key legends for special UNS symbols are identifiable by their location on the top of the key and can be color-coded so that a typist can easily differentiate them from the conventional legends. A thumb-actuated "WORD SPACE" function key 226 is provided along the bottom of the last row of keys 228.

As shown in FIG. 2, special printer function keys 232–239 are also provided to the right of the alphanumeric keyboard. A "RESET" key 232 is provided which, once power to the invention has been turned on, may be depressed at any time to initialize the electronics as will be discussed in more detail below. A "UNS-/ULNS" key 233 is provided which allows the typist to alternately designate whether a UNS or ULNS disc 18 is being used. An "AUTO KERN" key 234 is provided which allows the typist to alternately enable or disable the automatic kerning of certain character combinations for purposes that will be discussed below.

An "ADVANCE" function key 235 is provided to advance the tape 16 to be cut so that a leader is available on the end of the tape and on the beginning of the next tape as is conventional before and after a message or symbols have been printed on a tape 16. A first means for editing the message to be printed is provided by a "KILL WORD" function key 236 in the event of typing errors, depression of which will remove from the buffer all characters back to the last word space or advance entered into the buffer or the last unprinted character, whichever occurs first. If multiple words exist in the buffer 107', repeated depression of the KILL WORD key 236 will delete words, one for each depression.

Finally, special function keys 237–239 are provided to allow the typist to produce a plurality of messages or characters while only entering the desired message or characters on the keyboard once. The function keys and the functions initiated thereby also provide a means for displaying the message to be printed and a second means for editing or correcting the message. A "REPEAT QTY." function key 237 is provided which may be depressed immediately after power has been turned on or immediately after the "RESET" function key 232 has been depressed. Depressing the "REPEAT QTY." function key 237 causes the software to enter the repeat mode, after which the operator may enter on the keyboard 200 the number of copies desired and the message or characters to be printed. Both the quantity and the message are printed out on the tape to allow the operator to verify their correctness prior to initiating printing. If the message as displayed on the tape is incorrect the operator need only initiate the sequence again to obtain corrected copy.

A "PRINT" function key 238 is provided to initiate the printing of multiple copies. The "PAUSE" function key 239 is provided to suspend the printing of multiple copies, as may be desired to replenish the tape supply. Printing resumes when the "PRINT" function key 238 is depressed again. After the specified number of copies has been printed, the operator can repeat the printing of the same number of copies of the same message by depressing "PRINT" function key 238 again, or can resume normal use of the keyboard.

An alternative design may be used for legending the keys 228 of keyboard 200 with the legends for special symbols. The special symbols may be conveniently located on the front vertical surfaces of the alphabetic keys, which may be canted to display the symbols, and colored to match the color of the "UNS SHIFT" function keys 225.

Figure 3:
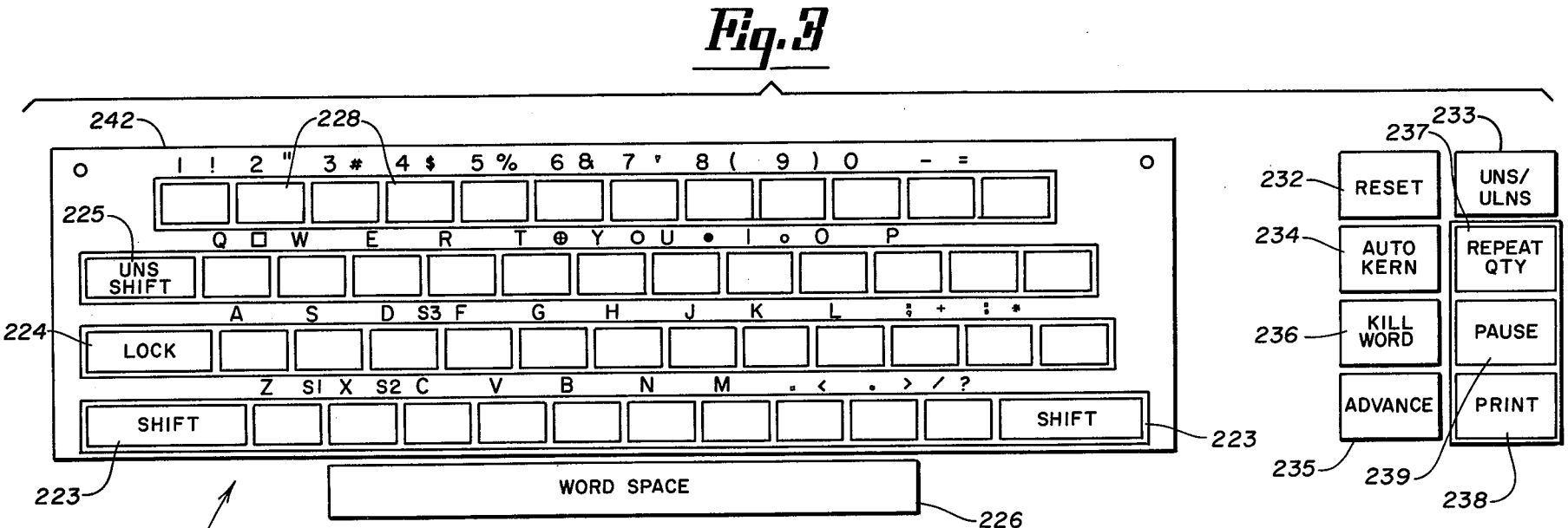
FIG. 3 shows an alternative design for the keyboard consisting of a panel which can be inserted over the character and function keys so that a plurality of keyboard panels can be used, each with different indicia subscribed thereon so that a plurality of different type discs or fonts can be related directly to the keys.

Shown in FIG. 3 is an alternative design for the keyboard 200 consisting of a panel 242 which can be inserted or slipped over the keys 228 so that a plurality of different type discs or fonts 18 can be related directly to the alphanumeric keys 228. A panel 242 for each different type disc 18 can be used and such panels 242 can be used for the conventional layout of European languages and other languages of the world or for many different symbols. Since the panel 242 is inserted over the keys 228 of the keyboard 200 all function keys 223–227, 232–239 remain and perform the same functions discussed above.

Alternative designs may also be used for the housing or enclosure that would accept any one of a number of different keyboards 200 and a hinged cover (not shown) may be provided to attenuate the audible noise produced by the printing apparatus 10.

Figure 4C:
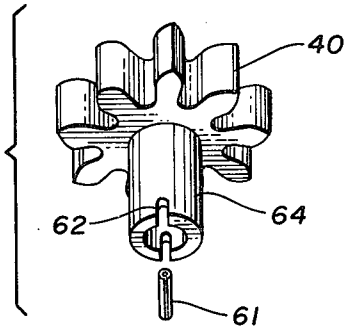
Figure 4A:
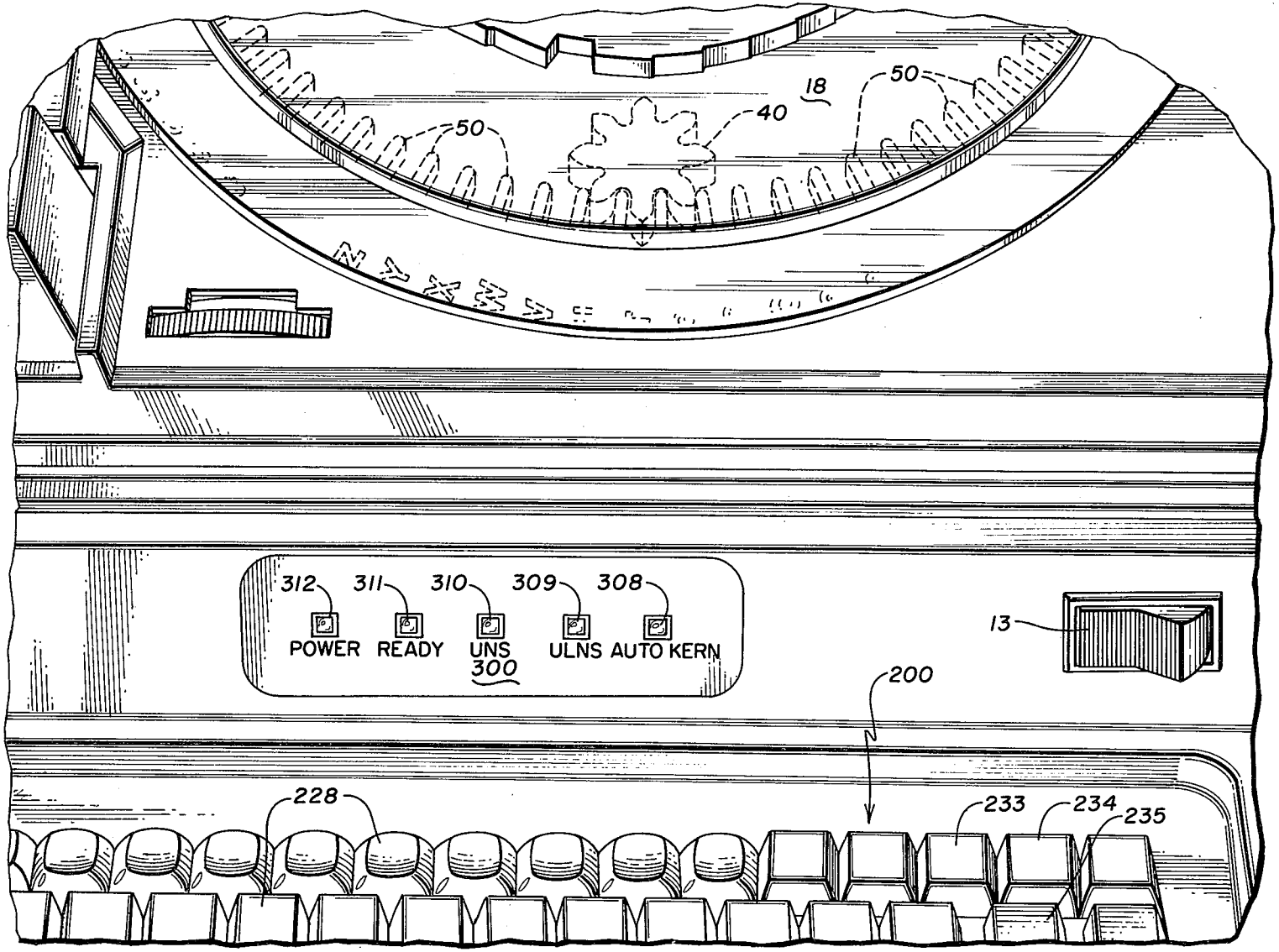

FIG. 4(*a*) is an enlarged partial detail of the instant invention taken with the type disc label removed to show the operational detail of the preferred type disc drive gear 40 and how it engages the type disc or font element 18 to rotate the disc 18 for alignment at the printing station 14. FIG. 4*a* also shows on/off switch 13 and visual display 300. The displays are individual light-emitting diodes (LEDs) 308–312 which indicate that "POWER" 312 is applied to the system, that the system is "READY" 311 to accept entries on the keyboard 200, whether a "UNS" 310 or "ULNS" 309 type disc of font element 18 is being used, and whether the "AUTO KERN" 308 feature is activated. FIGS. 4*b* and 4*c* show in detail how the gear 40 is operatively attached to the stepper motor 58 as will be discussed below.

Figure 5:
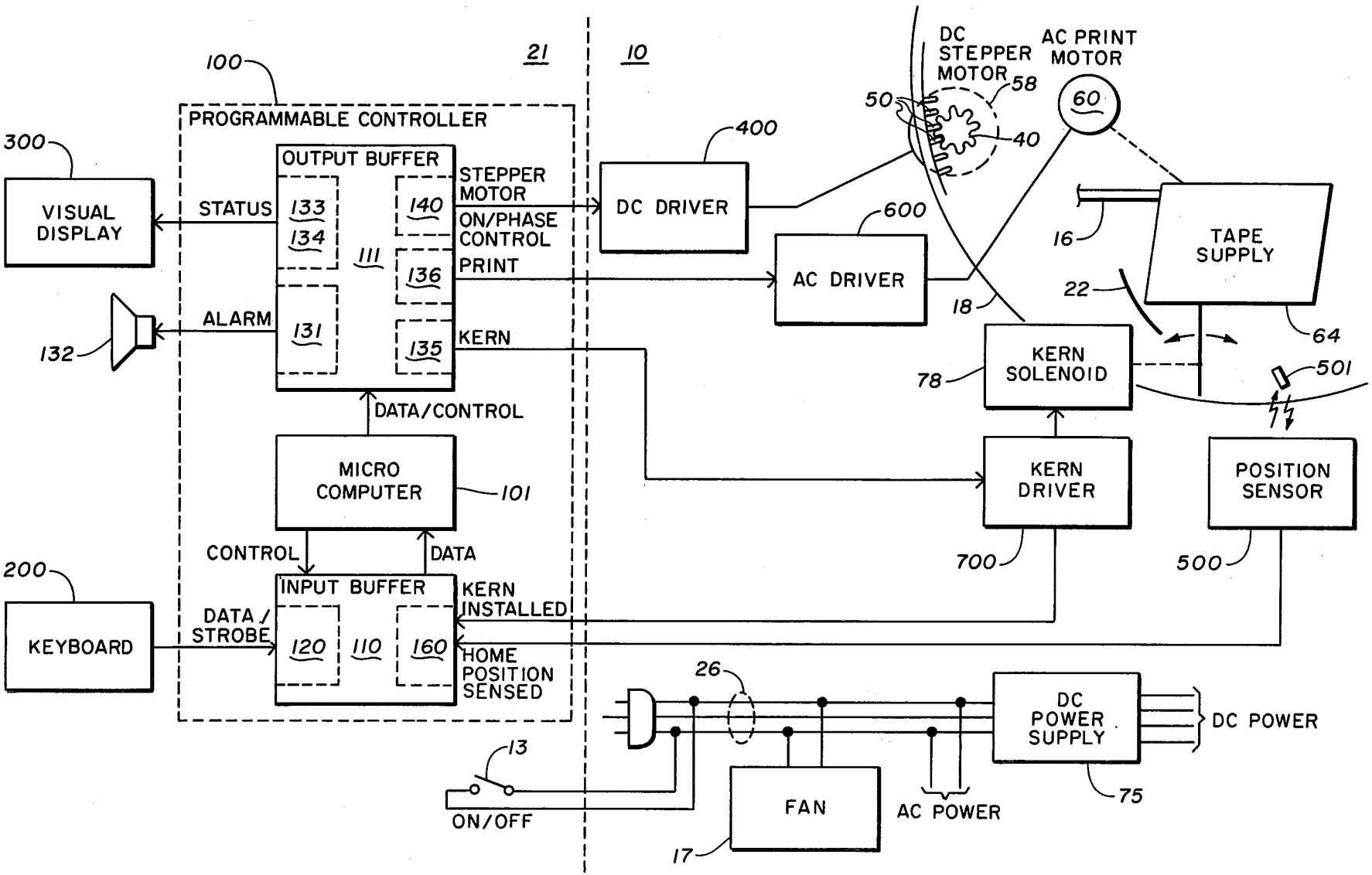
FIG. 5 is a simplified block diagram showing the operational features of the automated typing system.

FIG. 5 is a simplified block diagram showing the operational features of the automated typing system. Following turn-on, or whenever the operator depresses the "RESET" function key 232 the microcomputer 101 will perform a self-test of the system under software 901 control and the operator will observe the LEDs 308–311 lighting and unlighting. Upon successful completion of the test the "POWER," "READY" and "ULNS" indicators 312, 311, and 309, will remain on. The software 904 will then drive the disc 18 to the "home" position as sensed by position sensor 500.

The operator may change the software default selection of ULNS by pressing "UNS/ULNS" function key 233 and observing the "ULNS" indicator 309 go out and the "UNS" indicator light 310 go on. At this time the operator may also activate the "AUTO KERN" feature 916 by pressing "AUTO KERN" function key 234. The operator may then type onto the keyboard 200 whatever message the operator wishes to create on the tape 16. The operator may type at the operator's normal typing speed since input to the microcomputer 101 is received and stored in the one hundred twenty-eight character buffer 107'.

Preferably a software routine 950 keeps count of the number of characters in the buffer and at a selected number of characters prior to the end of the buffer causes audio transducer 132 to emit two audible tones if the operator is reaching the end of the buffer 107'. This alerts the operator to slow down to allow the printing apparatus 10 to print a number of characters from the buffer 107' so that the operator can enter additional characters into the buffer. If the operator continues to enter characters faster then they can be printed, the software will cause multiple tones to be sounded to alert the operator that the next entry may cause a character to be lost.

The control software is preferably provided, if a microprocessor is utilized, on a ROM 108 as part of the microcomputer 101. The control software causes the printing apparatus to successively print each letter, number, symbol or word space stored in the multiple character buffer 107'. This is accomplished successively with reference to FIG. 5 as follows.

Initially the programmable digital processing controller 100 causes the disc 18 to be driven to the home position without printing by activating DC driver 400 and a stepper motor 58 which is operatively connected to a gear 40, shown in detail in FIG. 4, which, as it rotates, engages a plurality of adjacent ribs or posts 50 positioned on the underside of the type disc or font 18 as shown in FIG. 4*a*. These ribs or posts 50 are the same elements used to precisely align the font 18 with an alignment member (not shown) which is fully described in U.S. Pat. No. 4,243,333. The drive gear 40 is mechanically connected to the stepper motor 58 by a pin operatively positioned in the collar of the gear 40 which is designed to fit over the shaft of the stepper motor 58. The creation of the ramp-up and ramp-down signal for the stepper motor 58 is accomplished with the microcomputer 101 and the number of pulses utilized to drive the stepper motor 58 to position the disc 18 will be discussed below with reference to the schematic diagram of the circuit.

When position sensor 500 signals to microcomputer 101 that the disc 18 has been positioned at the designated "home" position with the stepper motor 58 and the gear 40, the stepper motor 58 is deenergized so that the disc 18 can freely move, and the system is ready to print characters entered on the keyboard 200. Entering a character on the keyboard causes the type disc positioning function sequence to be repeated to position disc 18 so that the desired character is provided at the print station 14, after which the print cycle is initiated.

To cause a character to be printed, AC driver 600 is activated by a print signal from the programmable controller 100 which energizes the print motor 60. As fully disclosed in U.S. Pat. No. 4,243,333, energization of the print motor 60 causes the font 18 to be precisely aligned with an alignment member, causes a printing force to print the tape 16 to be exerted at the printing station 14 and advances the tape supply 64 in the manner taught by the referenced patent during and after the selected letter is being printed.

As also disclosed in the patent on the printing apparatus 10, a manual kern button 44 is supplied on the printing apparatus 10 operatively connected to the tape supply 64. Depressing the kern button 44 partially retracts the tape supply 64 before the print motor 60 is energized, causing the next character to be printed closer to the one just printed. The instant invention employs an improved means to retract automatically the tape supply 64, which means include a table of the combination of letters to be kerned stored in microcomputer 101, a kern driver 700 and an electromagnetic kern solenoid 78 hooked to the cam shaft in the printing apparatus 10 which operates the short space slide in the same manner as manual depression of the short space button as disclosed in U.S. Pat. No. 4,243,333 to advance tape supply 64.

After printing the selected letter the apparatus is then ready to print the next successive letter in the buffer.

In the preferred design of the instant invention, all processing and control is performed at the low voltage levels of conventional digital processing circuits included in the programmable controller 100, and high levels of voltage and current are confined to the environment of printing apparatus 10.

As also disclosed in the patent on the printing apparatus 10, a manual tape cut button 66 is supplied on the printing apparatus 10 operatively connected to a knife blade (not shown) to cut the tape 16.

Figure 6:
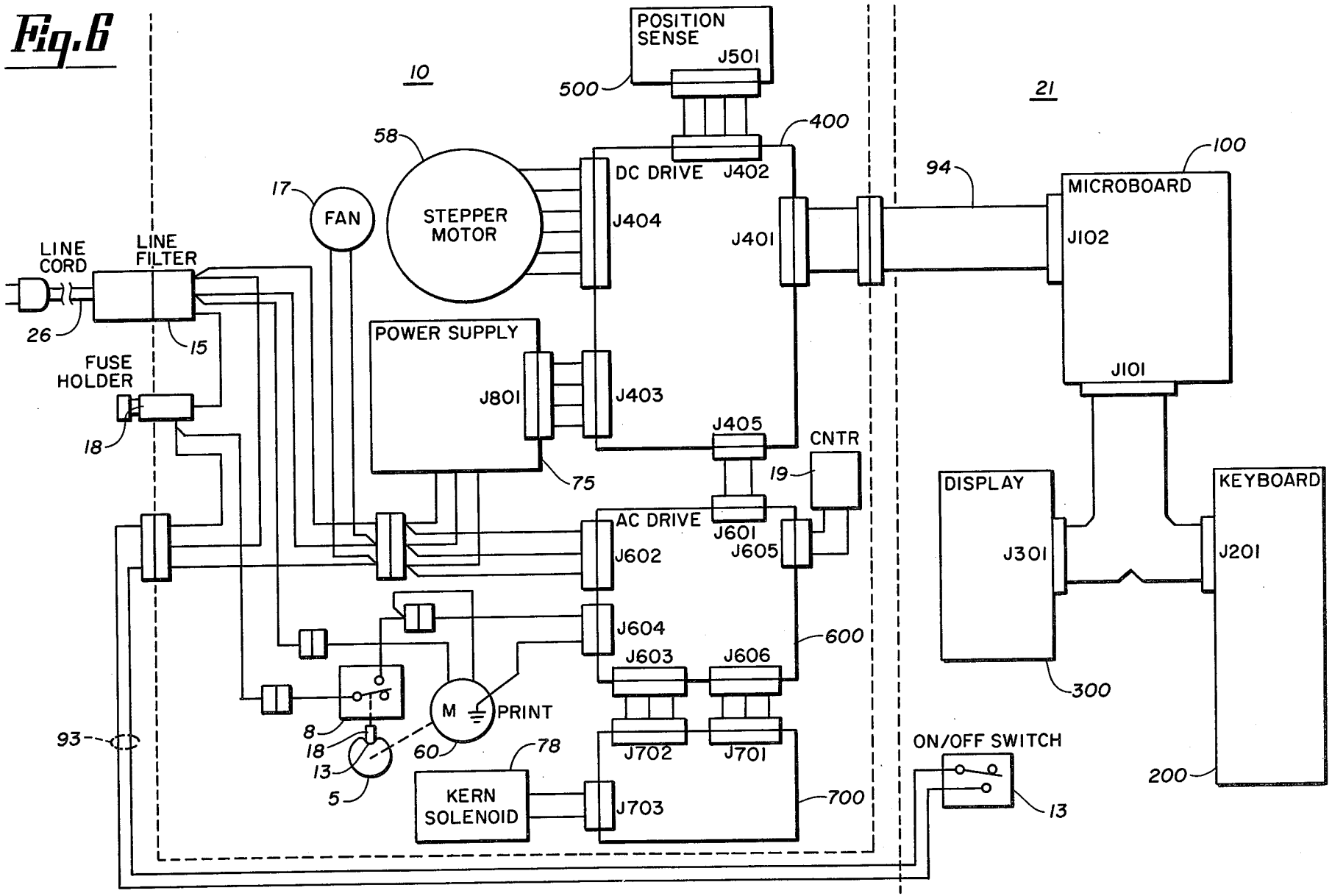
FIG. 6 is a schematic diagram showing the elements of the invention and how they are connected and cooperate together.

FIG. 6 is a schematic representation showing how the logic level signals are interfaced with the controlled elements of the invention. As shown schematically in FIG. 6, the programmable digital processing and control means 100 and all operator-interface means, which means include keyboard 200, on-off switch 13 and visual display 300, are enclosed in the keyboard housing 210. The means to interface the digital control signals to the electromechanical elements of printing apparatus 10 are enclosed in the printing apparatus 10.

Data entries on the keyboard 200 are supplied to microcomputer 101 as conventional eight-bit ASCII-encoded data and a strobe which signals a valid input to the microcomputer 101 from keyboard 200. Keyboard 200 can be a conventional commercially available keyboard such as the Cherry keyboard model B70-05AB.

Figure 7:
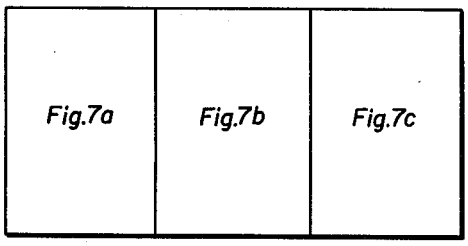
FIG. 7 is the layout of the schematic diagram shown in FIGS. 7*a*, 7*b*, and 7*c*.

Programmable digital processing and control means 100 is shown in more detail in FIG. 7 and includes a Z80 microprocessor 104 and associated reset 103, clock 102, timing circuit 109, memory 107 and 108, input/output buffers 110 and 111 and address decoder circuits 105 and 106, together with the logic circuits that monitor and control the electromechanical elements of the printing apparatus 10.

Referring back to FIG. 6, the programmable controller 100 receives operator input data from the keyboard 200, sends operator output data to visual display 300 and audio transducer 132, and exchanges status data and control signals with the interface means in the printing apparatus 10, which interface means include a DC driver 400, an AC driver 600, a kern driver 700, and a position sensor 500. As those experienced in the art will recognize, the definition, layout, location and routing of signals between elements is designed to economize the quantity and size of elements and to minimize the adverse effects caused by high levels of voltage and current and, in particular, transients thereof. To these ends, AC signals are routed via AC drive board 600 and DC signals via DC drive board 400. Individual interconnections are shown on the respective detailed schematics in FIGS. 9 through 12.

In the improved means of the instant invention, programmable controller 100 initiates the print cycle described above by causing AC driver 600 to apply power directly to print motor 60 until a microswitch 8 closes. Print motor driver 80 is then deactivated and switch 8 controls the rest of the print cycle.

As shown in FIG. 6, a mechanical cam 5 connected to the print motor 60 closes the microswitch 8 upon the initiation of rotation, which assures a full print cycle. Upon closure of the switch 8, the motor 60 is connected to the source of power until the concave cam surface 13 in the cam 5 allows cam follower pin 18 to fall, thereby opening the switch 8 and removing power from the print motor 60.

As fully disclosed in U.S. Pat. No. 4,243,333 a print cycle includes precisely aligning the type disc or font 18 for printing. Since the stepper motor 58 is deenergized at the time of alignment, the font 18 is freely movable for alignment. The print cycle also causes a sufficient print pressure to be created at the printing station 14 and, if a tape cartridge 64 is being used, reciprocates the tape cartridge to withdraw tape 16 and advance tape 16 for the next letter at the conclusion of the print cycle.

As also shown in FIG. 6 the printing apparatus 10 can be manually operated if the operator desires to do so. In this event switch 13 may be off and it is not necessary to disconnect the cables 93, 94 between the keyboard assembly 21 and the printer assembly 10. Since the stepper motor 58 will be receiving no signals from the microcomputer 101, it 58 will remain freely movable upon rotation of the knob 22 on the type disc or font 18. Power for the print motor 60 is supplied by the power cord assembly 26 shown in FIG. 6. Switch 13 removes AC power input from the system. This input is fused for purposes of safety.

In manual operation depression of the print lever 33 closes the microswitch 8 and connects the print motor 60 to the input line 26. Thereafter, rotation of the cam 5 will maintain the micro switch 8 in the closed position to complete the print cycle. The micro switch 8 will be opened and the print cycle will be terminated when the cam follower pin 18 returns to the concave cam surface 13 in the cam 5.

The instant invention is designed to operate from 110–120 volts AC, 60 Hz, power as is normally available in the United States, but the modifications and variations necessary to operate the invention on the standard voltages of other countries are considered within the purview and scope of the instant invention.

All electrical power to the invention is supplied by means of AC power cord and plug assembly 26 and is fused for safety by fuse 18. Frequencies capable of producing electromagnetic interference are attenuated by line filter 15. AC power is supplied directly to print motor 60, cooling fan 17 and event counter 19, and rectified to drive the kern solenoid 78.

The +5 and +15 volt DC voltages to power the digital devices and logic circuits of the instant invention are provided by a conventional, commercially available power supply 75 such as Sierracin Model AC 1114. Stepper Motor 58 is a variable reluctance motor selected because it exhibits no permanent magnetism that would impede manual operation of printing apparatus 10 as discussed above.

The electrical and electronic components described above are commercially available from the vendors such as set forth in the following table. As those skilled in the art will recognize from the disclosure, alternative means can be utilized to accomplish similar functions and the specification of commercially available components is for purposes of disclosure only and not meant to limit the invention as claimed.

| Description | Vendor | Part Number |
|---|---|---|
| Keyboard Assembly 200 | Cherry | B70-05AB |
| Power Supply Assembly 75 | Sierracin | AC 1114 |
| Stepper Motor 58 | Japan Servo Co. Ltd. | KP6R2-001 |
| Kern Solenoid 78 | Guardian | T8x16 |
| Event Counter 19 | Kessler-Ellis | KE610-R-DC12 |
| Fan 17 | Rotron | SU2A1 |

Referring now to FIGS. 7 through 12, the elements and functions of the individual circuit boards 100, 400, 500, 600, and 700, can be shown and understood by those experienced in the art.

FIG. 7 is a detailed schematic showing the elements of programmable controller 100 and how they cooperate together. Referring to FIG. 7, microcomputer 101 is a conventional microcomputer including a Z80 microprocessor 104, 1024 bytes of eight-bit static RAM 107, 2048 or 4096 eight-bit bytes of ROM 108, and clock 102, reset 103 and counter/timing circuits 109 of conventional design. Conventional one-of-eight decoders 105 and 106 provide the capability for the microprocessor 104 to selectively address and control RAM, ROM, input buffer 110, and output buffer 111. Conventional devices and techniques are used to terminate unused lines, to shield and filter data and power lines, and to buffer all transmission lines. Inverting and noninverting integrated circuits are used as necessary to assure that all input and output signals are low when active as seen at the input buffer 110, output buffer 111, and at the interfaces between printed-circuit boards.

Input buffer 110 receives eight-bit, ASCII-encoded data from keyboard 200 input 120, together with a strobe 122 that indicates valid input data. The strobe is used to clock each ASCII character into the input buffer 110, and is also connected to timer 109 to generate an interrupt signal INT to the Z80 microprocessor 104 from pin 12 of timer 109. The interrupt causes the microprocessor 104 to begin executing the program, which will be described in detail below, to process the interrupt to transfer the character to be printed into the multiple character software input buffer 107', and initiate the sequence of events to position the type disc 18 and print the character on tape 16.

The output buffer 111 is connected to a driver 131 which converts the logic level signals from the microcomputer 101 to operating signals for the audible alarm 132 which sounds when the operator is near the end of the character buffer 107', a stepper motor control 140 which receives and transmits the pulses to drive the stepper motor 58 as will be discussed below, and a print motor control 136 to cause the print motor 60 to align the type disc 18, print the character and advance the tape 16 for the next successive character, and provides control signals for visual display and kerning.

The logic signal from the microcomputer 101 to the audible alarm circuit 130 from output pin 15 of output buffer 111 to alarm driver 131 consists of a series of logic level pulses at a frequency to create a buzzer sound out of a speaker 132 for a time period which can be set by the software, for example, ten seconds. The pulse train is converted from logic level signals to a drive signal with sufficient current and power to drive a speaker 132 with non-inverting driver 131. Thus, when a selected number of characters has been entered into the one hundred twenty-eight character buffer 107', for example, one hundred eight alphanumeric characters, symbols or word spaces, the alarm 132 will sound to alert the operator to slow down to allow the printing apparatus 10 to print. However, since the tape being produced is display type quality, such as for headlining, in most situations a line of tape 16 will not exceed the capacity of the buffer 107'. If the typist continues to exceed the speed of the printing apparatus, the alarm under program 950 control will sound five times to alert the typist that continued entries on a keyboard 200 cause characters entered previously to be lost.

The stepper motor 58 controls from the microcomputer 101 are provided from three pins of the output buffer 111, pins 2, 5 and 9, which are connected to stepper motor translator 140. The signal on output pin 9 is the stepper motor on-off signal and is inverted by gate 147 and connected to the phase control NAND gates 151, 152, 153, and 154.

Also provided to the stepper motor translator 140 are alternative signals. A direction to turn the stepper motor 58 clockwise will appeaar on output pin 2 of the output buffer to input pin 4 of the stepper motor counter 141, causing the counter to count down. Complementary signals are formed by logic gates 142 through 146 and supplied to the phase control AND gates 151 through 154. Alternatively, the microcomputer 101 output may be on pin 5 of the output buffer which will cause the counter to count up and stepper motor 58 to rotate in a counterclockwise direction. As will be described in detail below, the software functions to determine the position of the next letter to be printed from the last letter printed and then causes the type disc 18 to move the shortest distance in either direction to the next letter to be printed.

After the cycle for printing the previous character is completed the software initiates a series of control signals in sequence to position the type disc 18 to print the next letter. A "MOTOR ON" signal appears on output pin 9 of the output buffer 111. A time delay is initiated to allow the motor 58 to normalize. Thereafter a ramp-up and ramp-down signal will be emitted from output pin 2 or output pin 5 of the output buffer 111 depending on the position on the type disc 18 of the next letter to be printed which determines the direction of rotation and amount of rotation that is necessary. Twenty-five pulses per character position are utilized to rotate the stepper motor 58 as will be discussed in more detail below. After a time interval determined by the software of sufficient duration to allow the type disc 18 to be positioned to the next succeeding letter, the signal on output pin 9 of the output buffer 111 is removed to turn off the stepper motor 58.

At the end of this sequence, the motor 58 is deenergized and freely rotatable so that during the print sequence, alignment means (not shown) can be used to precisely align the disc 18 by positioning an alignment member (not shown) between the ribs 50 at the print station 14.

The stepper motor translator 140 operates in the conventional manner by taking the input signal and providing a drive to two of four phases, the selection of phases depending upon whether the stepper motor 58 is driving the disc 18 in a clockwise or counterclockwise rotation.

The rotation of the stepper motor 58 causes the drive gear 40 to rotate the disc 18 as schematically shown in FIG. 5. The drive gear 40 is mechanically connected to the stepper motor 58 by a roll pin 61 operatively positioned in a slot 62 in the collar 64 of the gear 40 which fits over the shaft of the stepper motor 58 as shown in more detail in FIGS. **4*b* and 4*c***.

When a pulse is applied to the appropriate phase windings of DC stepper motor 58, the motor rotates one and eight tenths degrees. Thus it requires two hundred pulses for the stepper motor to make one complete revolution. Because the preferred gear design has eight cogs and the type discs have eighty slots, the gear ratio is 10:1. Thus it requires $200 \times 10$, or two thousand pulses to the stepper motor to rotate the disc one revolution.

Accordingly, twenty-five pulses per position are necessary to move the disc 18 one letter position. Twenty-five pulses per position are more than adequate to position the proper letter in the appropriate position for printing since, after the letter is positioned by the drive gear 40, the stepper motor 58 is deenergized making the disc 18 freely rotatable and thereafter during the print cycle the type disc 18 is precisely aligned at the print station with an alignment member (not shown).

Under software control, routines 927, 928, the programmable controller 100 verifies the position of the type disc 18 and, if necessary, reinitiates it to the "home" position. Position sensor 500 produces a signal when it detects light from a reflective strip 501 on type disc 18. This signal is received at J102, pin 14 of the controller, buffered and inverted by gate 161, and connected to timer/interrupt control 109 of microcomputer 101.

The electrical and electronic components of programmable controller 100 are commercially available from the vendors, such as those set forth in the following table. As those skilled in the art will recongize from the disclosure, alternative means can be utilized to accomplish similar functions and the specification of commercially available components is for purposes of disclosure only and not meant to limit the invention as claimed. For example, a Mostek CPU, Vendor No. MDX-CPU2 can be used for the microcomputer 101 and a Mostek PI0 Assembly can be used for the input, output buffers 110, 111.

| Description | Vendor(s) | Part Number |
|---|---|---|
| Clock Oscillator Module 181 | Dale; Motorola | 4.9152MHz |
| Audio Transducer 132 | Projects Unlimited | AT32 |
| Microprocessor 104 | Mostek; Zilog | Z80 |
| 1 of 8 Decoder, 105, 106 | Texas Instruments | 74LS138 |
| RAM 107 | Mostek; Zilog | MK4118 |
| *ROM, 2K × 8 Bits; 108 | Mostek; Intel | 2716 |
| *ROM, 4K × 8 Bits; 108 | Mostek; Intel | 2732 |
| Timer/Interrupt Control, 109 | Mostek Zilog | Z80-CTC |
| Input and Output Buffers, 110, 111 | Texas Instruments | 74LS374 |
| Stepper Motor Translator 4 Bit Counter, 141 | Texas Instruments | 74LS193 |

*Physically interchangeable.

Figure 8:
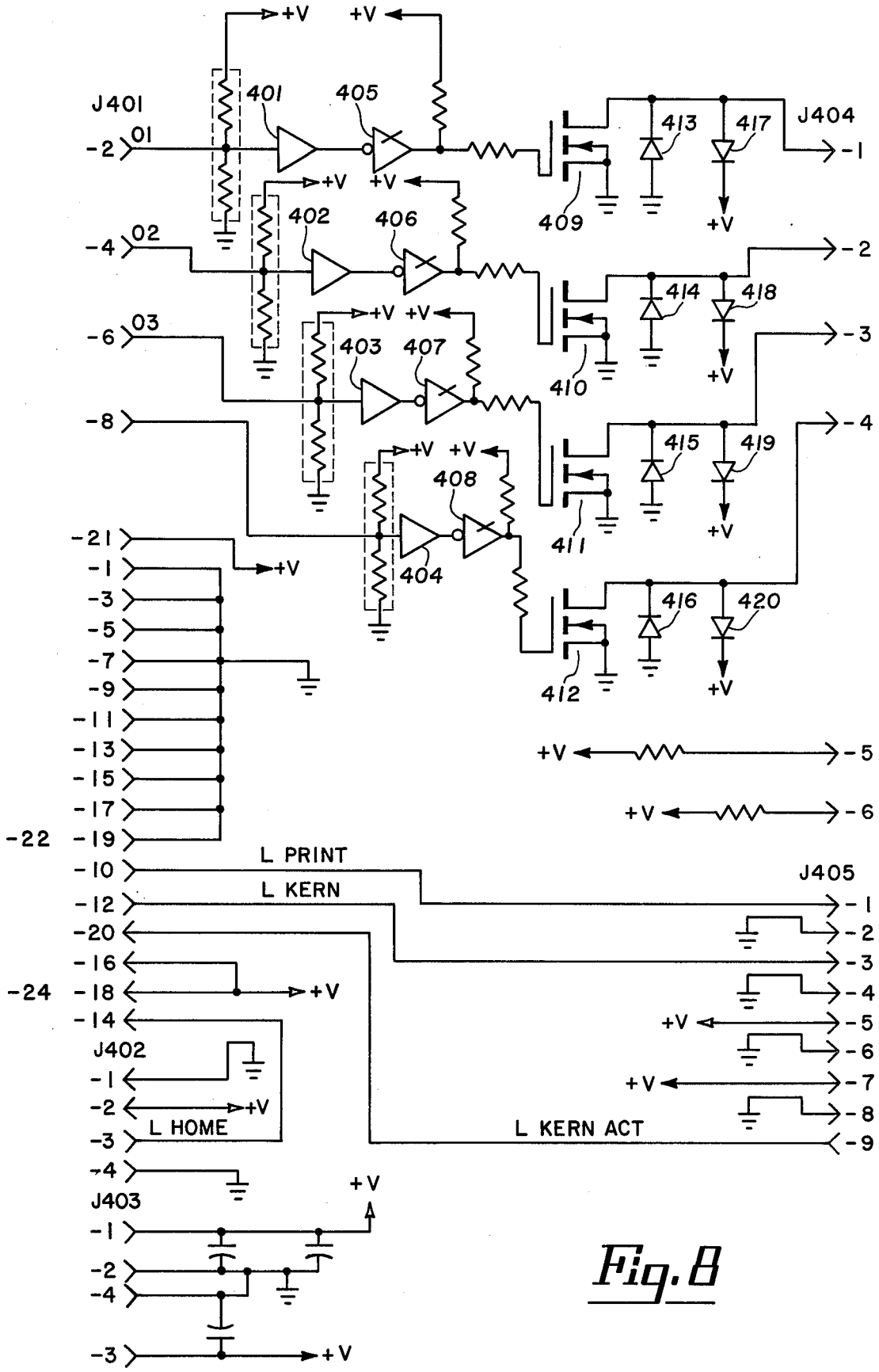
FIG. 8 is a schematic diagram of a Direct Current (D.C.) driver used to generate DC signals such as the signals to operate and control the Stepper Motor to rotate the type disc.

Referring to FIG. 8, it can now be shown and understood how DC pulses are supplied to the DC stepper motor 58. FIG. 8 is a schematic diagram of the DC drive circuits 500 that convert the logic levels of programmable controller 100 to high levels of DC drive current. The stepper motor phase control signals from pins 2, 4, 6, and 8 of J102 are connected to the corresponding pins of J401 on DC drive board 400. As shown in FIG. 8, the phase control signals are connected serially to noninverting buffers 401 through 404, and to inverting drivers 405 through 408 that provide the power to drive FETs 409 through 412. Transient suppression diodes 413 through 420 limit the amplitude of transients caused by the inductive characteristics of the stepper motor phase windings. The output signals from J 404 are connected to the stepper motor 58 as shown in FIG. 6.

Figure 9:
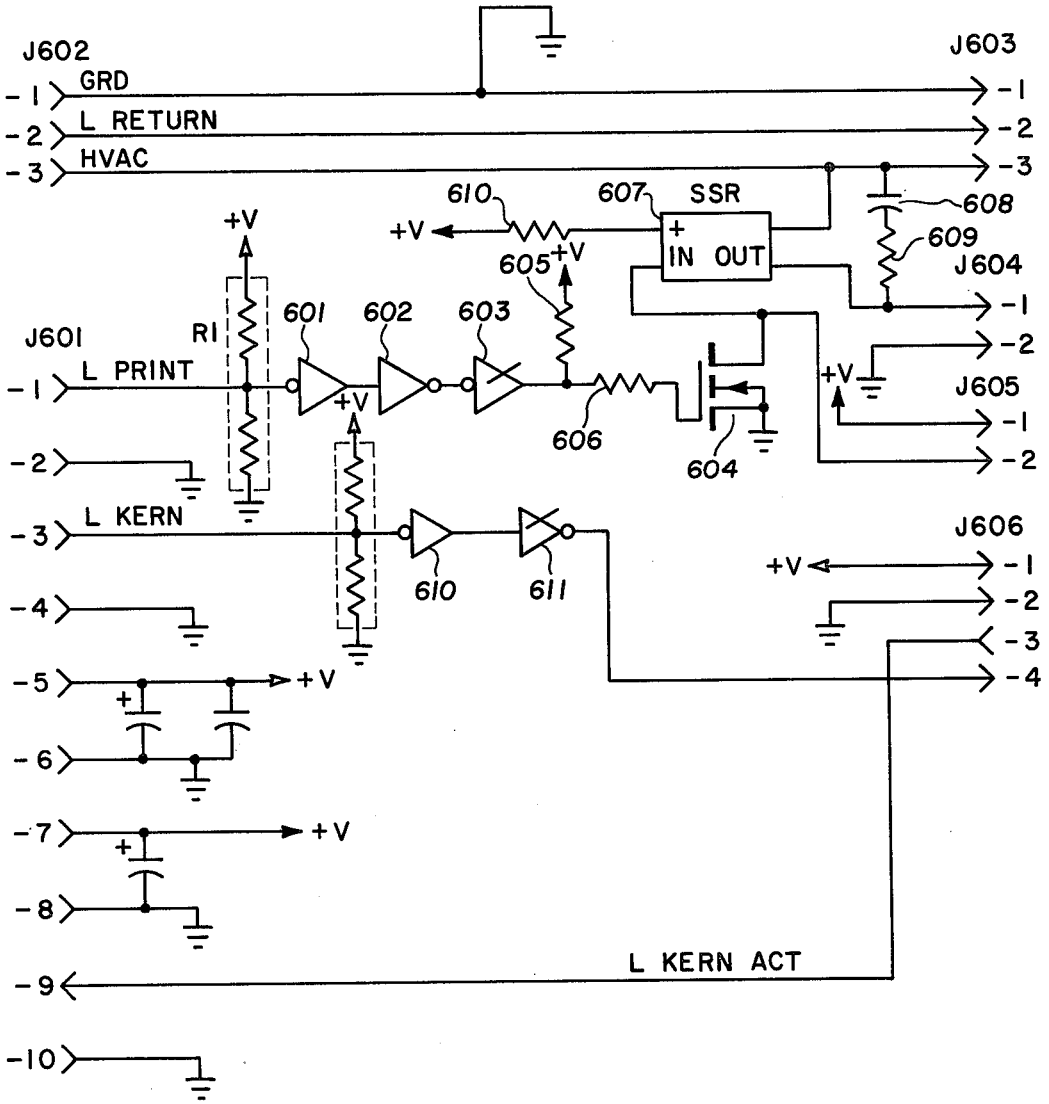
FIG. 9 is a schematic diagram of the Alternating Current (A.C.) Drivers used to generate AC signals to control the print motor and kerning controls.

The signal to activate the print cycle of printing apparatus 10 is connected serially from J102, pin 10 of programmable controller 100 to J401, pin 10, directly to J405, pin 1, and to J601, pin 1 of AC driver 600. Referring now to FIG. 9, it can be shown and understood how AC drive power is applied to print motor 60.

FIG. 9 is a schematic diagram of the elements of AC driver 600 and how they cooperate together. On AC driver 600, the print control signal is serially buffered, inverted and amplified by gates 601 through 603, and connected to the gate of FET 604. FET 604 turns on, activating the input of solid-state relay 607, which switches AC power to the print motor 60 through pins 1 and 2 of J604. Resistors 605 and 606 set the bias level for the FET, and resistor 610 limits current through the input of SSR 607. Resistor 609 and capacitor 608 form a snubber network to dampen transients caused by the inductive characteristics of print motor 60.

When the software determines that a character must be kerned, or printed closer to the previous one, it must cause the kern solenoid 78 to be activated prior to printing the character to be kerned. To accomplish kerning, microcomputer 101 causes an output from pin 12 of the output buffer, through noninverting driver 135, to pin 12 of J102 (FIG. 7). From there, it is connected serially to J401, pin 12 of DC drive 400 (FIG. 8) directly to J405, pin 3, and to J601, pin 3 of AC driver 600 (FIG. 9). From there it is buffered and amplified by gates 610 and 611 and connected serially from J606, pin 4 to J701, pin 4 of kern driver 700 (FIG. 10).

Figure 10:
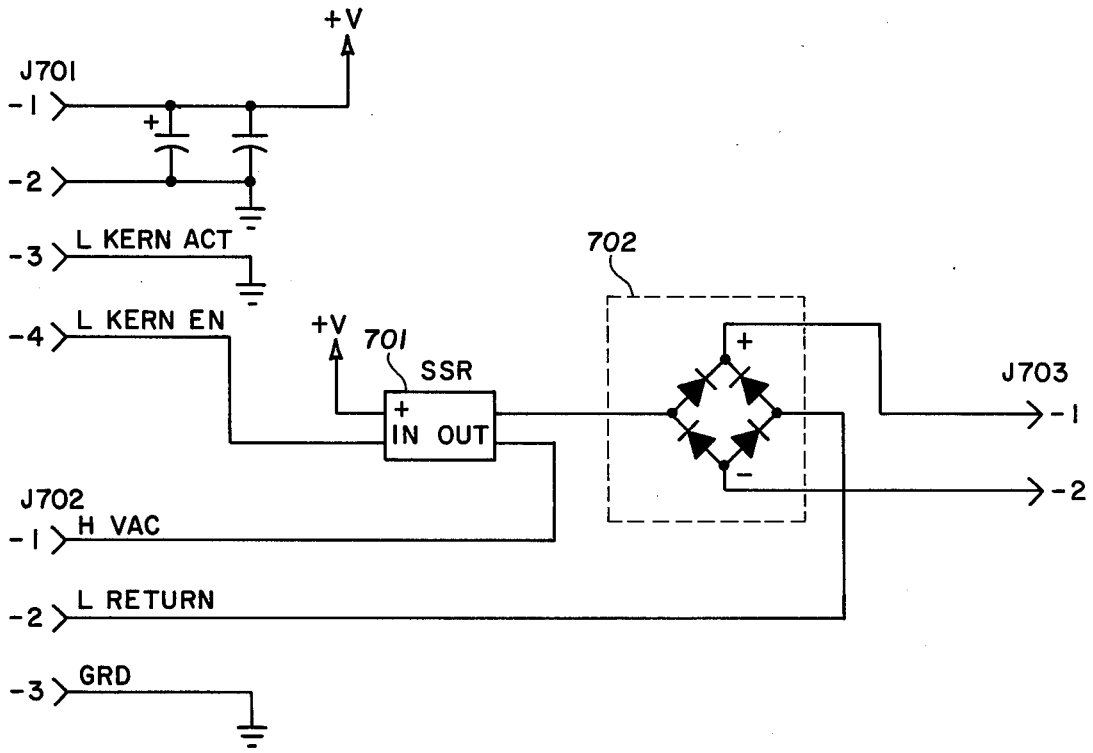
FIG. 10 is a schematic diagram showing further elements of the kern driver control

Referring now to FIG. 10, it can be shown and understood how rectified AC power is supplied to kern solenoid 78. FIG. 10 is a schematic diagram of the elements of kern driver 700 and how they cooperate together. From J701, pin 4 the kern control signal is connected to the input of solid-state relay 701. Optically-isolated relay 702 applies AC line power to full-wave rectifier 701. The rectified AC is connected from J703 pins 1 and 2 to the coil of kern solenoid 78. To allow programmable controller 100 to determine whether the kern capability is installed, a ground signal is connected from pin 3 of J701, through AC drive 600 and DC driver 400, to pin 20 of programmable controller J102.

Figure 11:
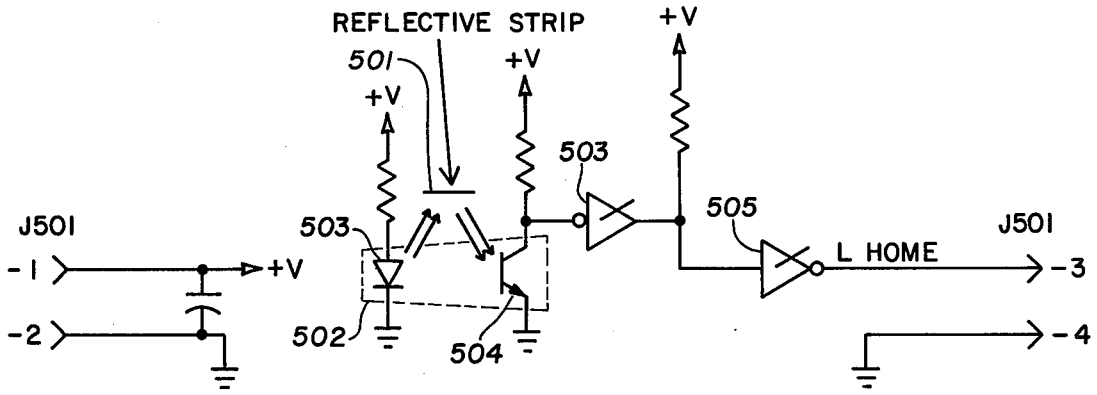
FIG. 11 is a schematic diagram showing the elements of the position sensor used to detect the position of the disc and provide a control signal to correctly preposition the type disc.

FIG. 11 is a schematic diagram of the elements of position sensor 500 and how they cooperate together. Reflective sensor assembly 502 consists of LED 503 that emits light continuously, and photosensitive transistor 504 that is activated by light reflected from reflective tape 501. Phototransistor 504 is connected serially to inverter 503, inverting buffer 505, pin 3 of J501, DC driver 400, pin 3 of J402, pin 14 of J401, and pin 14 of programmable controller J102.

Figure 12:
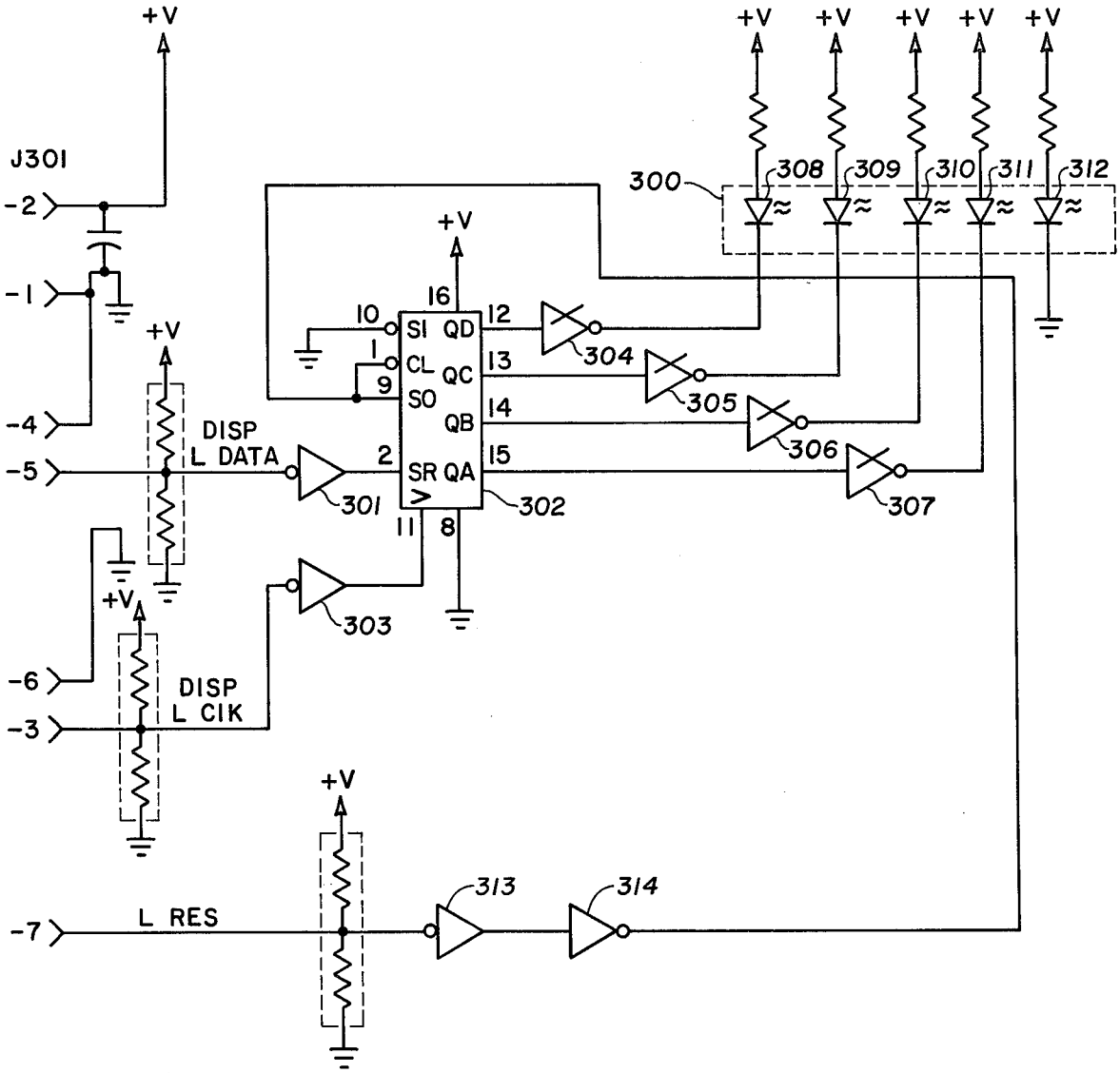
FIG. 12 is a schematic diagram showing the elements of the visual display indicating system status to the operator.
Figure 13D:
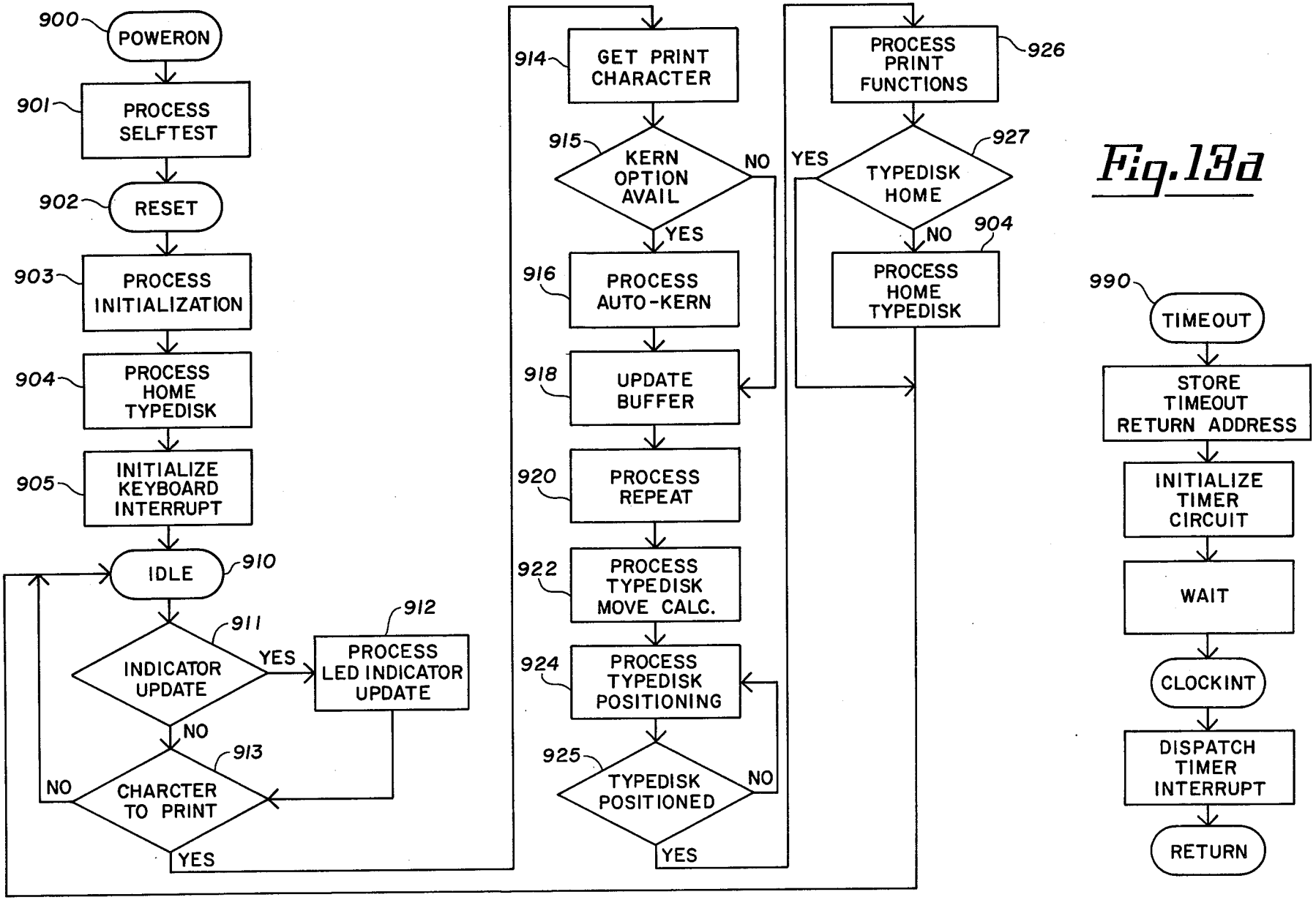
FIGS. 13*a* and 13*b* are a functional flow chart of the software used in the microcomputer to provide the control signals necessary to print out automatically and sequentially high quality lettered tape with the instant invention.
Figure 13B:
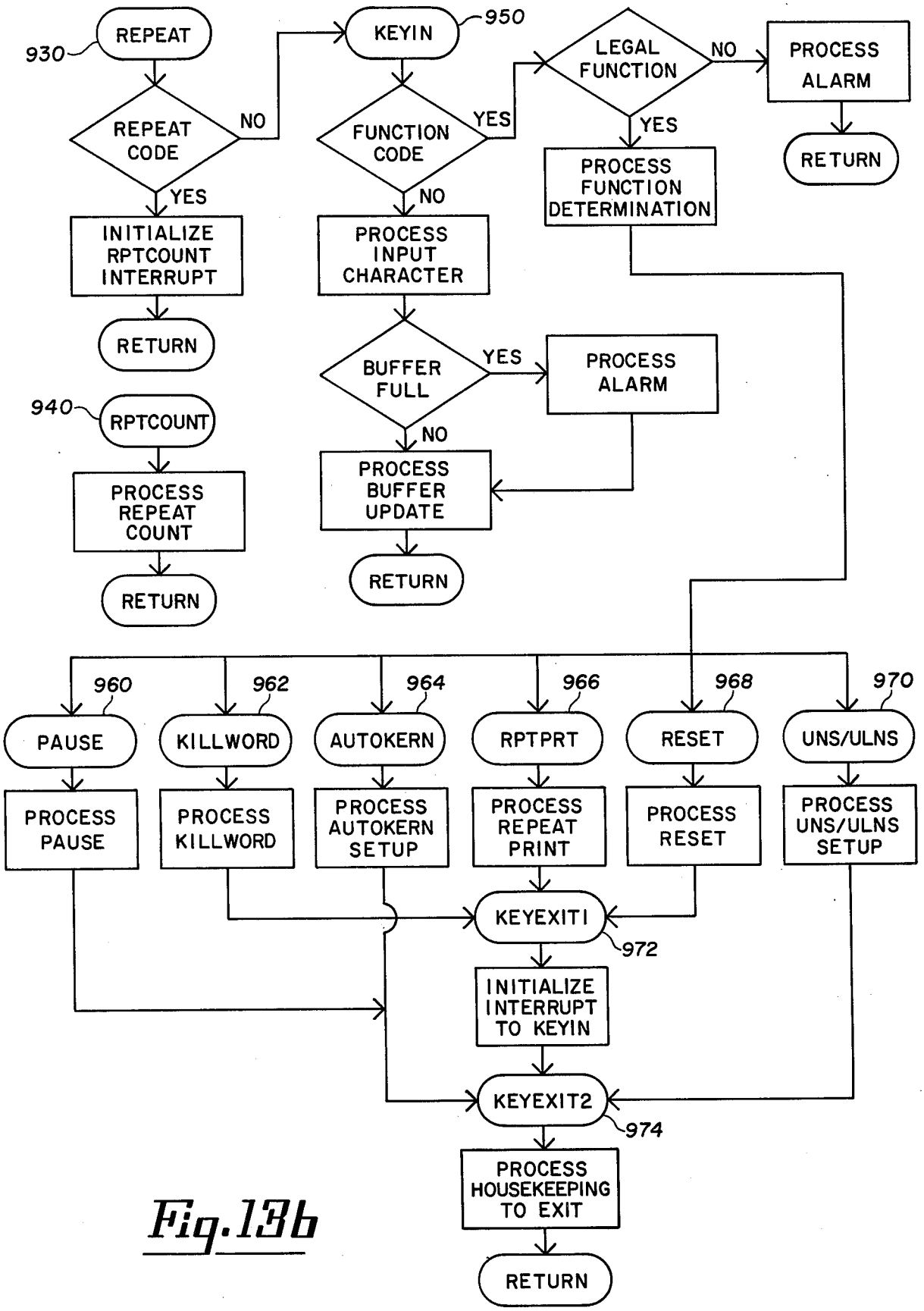

FIG. 12 is a schematic diagram of the elements of visual display 300 and how they cooperate together. Data to be displayed by the LEDs is received serially at pin 5 of J301 from programmable controller 100, pin 30 of J101, and clocked into shift register 302 by the clock signal from pin 32 of J101 to pin 3 of J301 and to inverting buffer 303. The logic signals shifted into shift register 302 are connected to LED drivers 304 through 306, causing the corresponding LEDs 308 through 312 to light. Programmable controller 100 can clear the display by sending a reset signal from pin 28 of J101 to Pin 7 of J301, where it is connected serially to inverting buffer 313, inverter 314, and pins 1 and 9 of shift register 302.

The electrical and electronic components of the various circuits 300, 400, 500, 600 and 700, are also commercially available as set forth in the following table. However, as with the programmable controller 100, those skilled in the art will recognize that alternative means can be used to perform the same or similar functions and that the following specification of components is for purposes of disclosure and not meant to limit the invention as claimed.

| Description | Vendor(s) | Part No. |
|---|---|---|
| Visual Display, 300 | | |
| LED, Amber | Litronix | CQV19-4 |
| LED, Green | Litronix | CQV18-4 |
| Reflective Sensor Assembly 502 | Spectronix | SPX-2498-3 |
| D.C. Driver 400 | | |
| FET 409-412 | Siliconix; Intersil | VN46AF |
| Position Sensor, 500 | | |
| Infrared Transmitter Detector Assembly 502 | Spectronix | SPX-2498-3 |
| A.C. Driver 600 | | |
| FET 604 | Siliconix; Intersil | VN46AF |
| Solid-State Relay 607 | Sigma | 226REI-5A1 |
| Kern Driver, 700 | | |
| Solid-State Relay 701 | Sigma | 226REI-5A1 |
| Bridge Rectifier 702 | EDI | PF20 |

Figure 13:
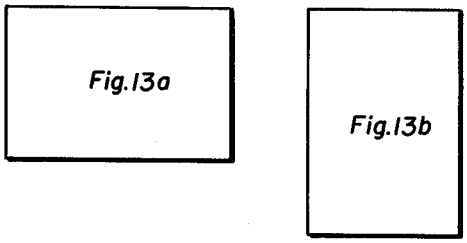
FIG. 13 is the layout of the functional flow chart shown in FIGS. 13*a* and 13*b*
Figure 7A:
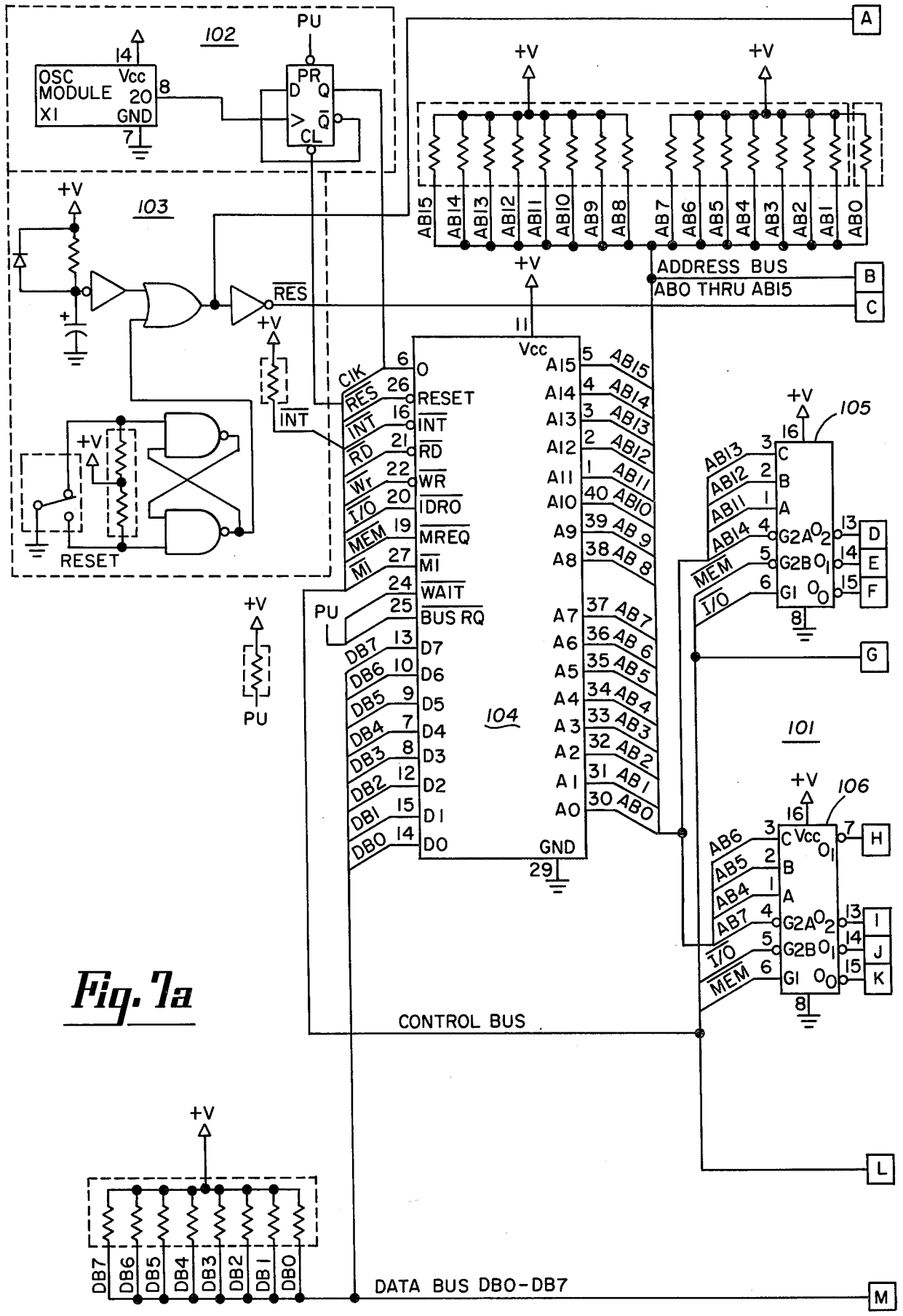
FIGS. 7*a*, 7*b*, and 7*c* are a schematic diagram of the preferred programmable controller.
Figure 7B:
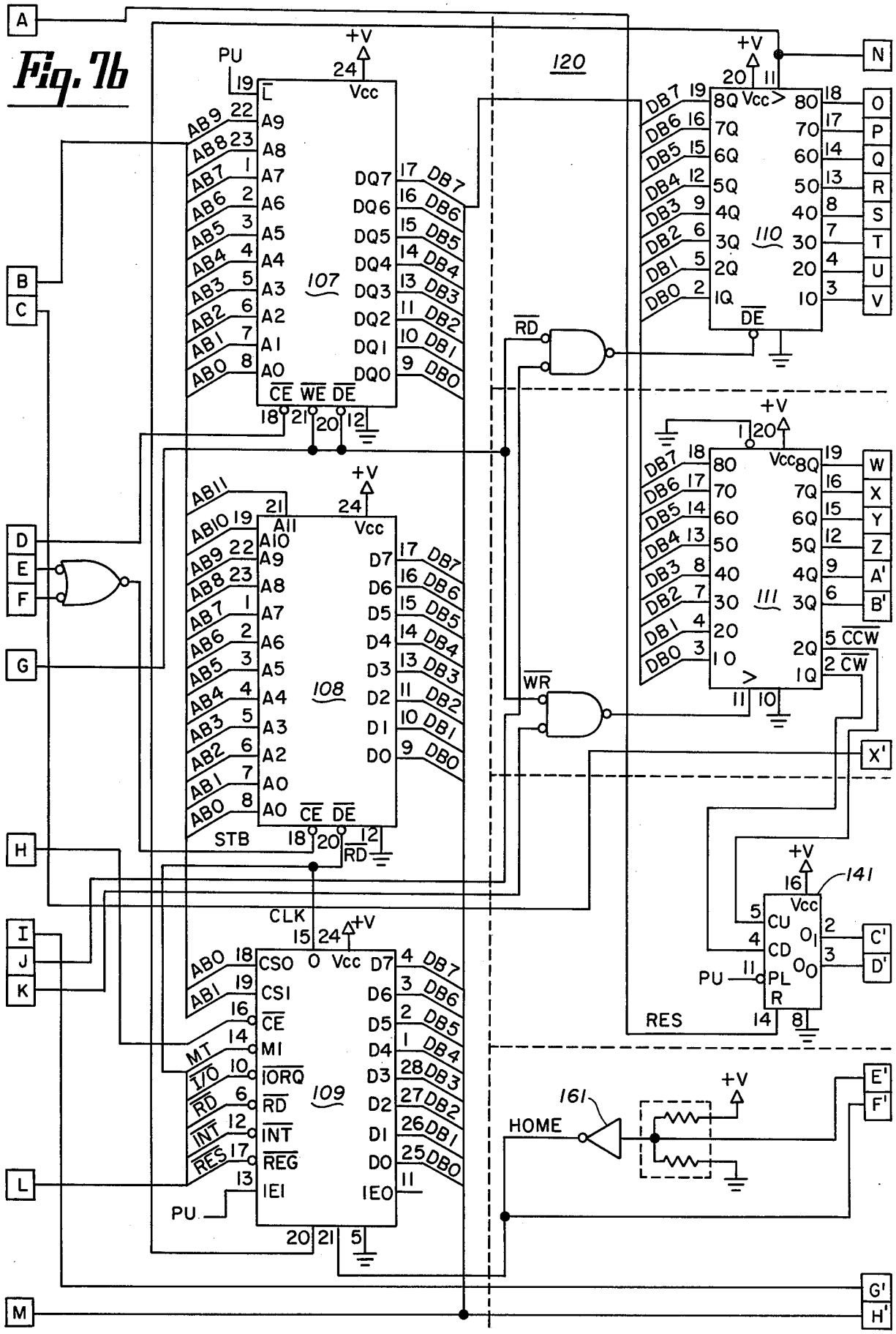
Figure 7C:
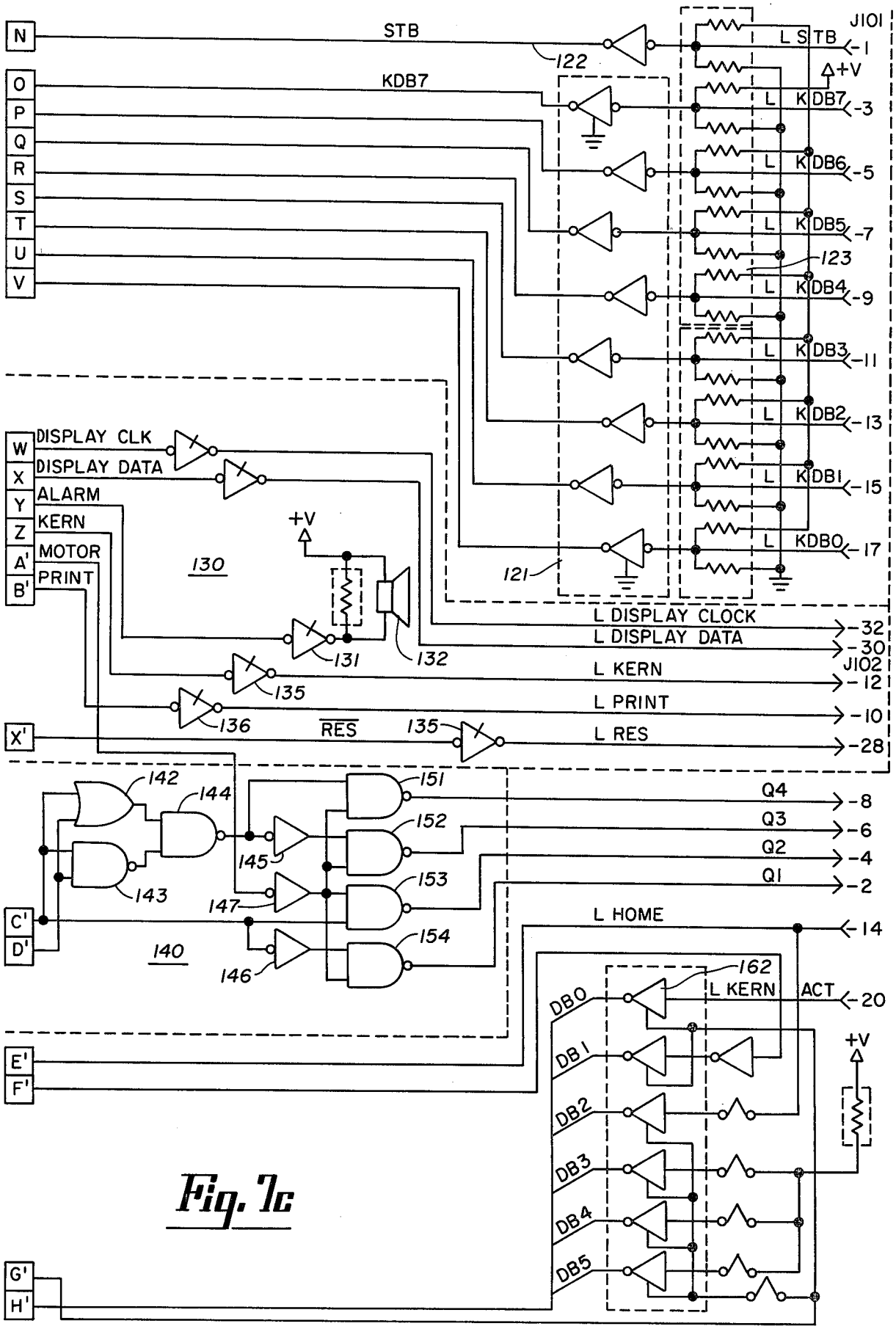

Referring now to FIG. 13, software control can be understood in view of the electromechanical operation discussed above.

FIG. 13 is a functional flow chart of the software, a full and detailed listing for which is included as a Microfiche Appendix and incorporated herein by reference, which discloses and teaches the control software for the invention. Microcomputer reset circuit 103 provides two means of causing the software to begin executing at the lowest memory location: power switch 13 being set to on, or manual activation of the master clear signal in reset circuit 103. Once the software begins to execute, it controls the functions and performance of the printing system unitl power is turned off or a master clear signal is applied.

With the above exceptions and once in control, the software determines when and how it may be interrupted or communicated with. Basically, the control program of the instant invention initializes the system and waits for input from keyboard 200. Once an input is received, it is processed to determine the appropriate actions to be performed, the necessary functions are initiated and either monitored or timed, and the software resumes waiting for the next event that requires its attention.

Software functions 900–905 basically initialize the system. Software functions 910–927, 904 and 990 sequentially operate in timed sequence to get a character to print, check for kerning and kern, position the type disc 18 with the stepper motor 58 and print the character. If a function key or character key is depressed the keyboard strobe causes the microcomputer 101 to store the address of the next instruction which is to be executed in the print routines 910–927, 990, in the RAM 107 as the "interrupted address", process the input associated with the keyboard strobe and return to the "interrupted address" in the print routines 910–927, 990. If the reset function key 232 is depressed the address for the Repeat function routine 930 is stored as the "interrupt address" to process the next keyboard strobe from the keyboard 200. If the Repeat function key 237 is then depressed, the address of the Rptcount routine 940 becomes the next "interrupt address" to receive the keyboard 200 input. If the Repeat code is not received control is passed to the Keyin routine 950 and the "interrupt address" is set to the Keyin routine 950. In this manner the other functions 902, 960, 962, 964, 966, 968, 970, are processed, and characters are stored for printing; all at speeds that do not affect the resumption and completion of the print routines 910–927, 904 and 990.

The control software for the instant invention maintains control of the invention in one of three modes: reset, input or repeat.

Reset mode is entered at power on or when the reset function key is pressed. Reset mode is used to allow data input which describes the type disc 18 to be used. The reset routine 902 will initialize the type disc 18 to ULNS unless the operator presses the ULNS/UNS function key 223 to change the software type disc identifier. The Reset function key 232 must also be pressed prior to entering the Repeat mode from Input mode.

Input mode is the normal mode in which the programmable controller 100 will allow the operator to input and print data. When in input mode, the data entered is saved in and printed from the multiple character buffer 107'.

Repeat mode is used to allow the operator to repeat strings of text with the printing apparatus 10. Repeat mode can only be entered from Reset mode.

All circuitry is initialized by turning the power on switch 13 to on.

The power on initialize routine 900 initializes the microcomputer to allow processing of the self test routines. The self test routine 901 assures correct operation of the electronic circuitry, such as address and data lines to and functioning of the RAM 107, ROM 108 and clock 109. The operator is notified of any failure by a bell tone.

The reset initialize routine 902 performs the initialization of all working storage, pointers and software buffer areas. The various input-output devices 110, 111 are then initialized as is the microprocessor 101 clock timer circuits 109. The reset initialization routine 902 then initializes the type disc 18 software identifier to ULNS.

The process home type disc routine 904 causes the type disc 18 to be automatically positioned to the word space (home) position as determined by the position sensor 500. The purpose of the routine is to insure accurate positioning of the type disc 18 which does not require presetting by the operator, and to insure accurate positioning of the type disc 18 during the operation of the device.

The initialize keyboard interrupt routine 905 performs the task of setting the proper keyboard interrupt address. Initially, after Reset, the keyboard interrupt is set to address Repeat.

The reset routines 903, 904, 905, can be entered by depression of the reset function key 232. The effect of reset cancels the operation of the device and reinitializes the system in the manner of routine 902 for further operation, possibly with a different type disc 18.

The idle routine 910–913 is essentially a wait loop which is executed whenever there is no activity required by the automated typing apparatus. The idle routine 910–913 will be interrupted by the keyboard interrupt. The idle routine will update the operator display 300 LED's when necessary and initiate the print routines when there is data in the print buffer.

The keyboard handling routines Repeat 930, repeatcount 940 and Keyin 950 are used to receive data from the keyboard, analyze the data, and then perform the appropriate operation. These routines 930, 940 and 950 are entered when an interrupt is recognized from the keyboard 200 generated by a keyboard strobe as described in connection with FIG. 7.

The Repeat routine 930 is only enabled immediately following a reset initialization. The routine is entered whenever an interrupt occurs and the interrupt address is set to the Repeat routine 930. The repeat routine inputs the data character and initializes the interrupt address to Rptcount upon receipt of a repeat code caused by depression of Repeat function key 237. Upon receipt of any code other than Repeat the routine initializes the interrupt address to Keyin 950.

The Rptcount routine 940 is entered whenever a keyboard interrupt occurs and the interrupt address is set to Rptcount. The routine causes the keyboard character to be input and analyzed. If the character is not numeric it is ignored and the routine returns to the interrupted address in the printing cycle (Routines 910–927, 904 and 990).

If the character is numeric it is stored until the total repeat count, two characters, is received. The routine 940 then stores the repeat count, initializes the interrupt address to Keyin 950 and returns to the interrupted address.

The keyin routine 950 is entered whenever there is a keyboard interrupt and the interrupt address is set to Keyin 950. The purpose of the routine is to receive and process data or special function codes. The routine first tests for valid function codes. If an invalid code is received due to a hardware error, a tone is sounded, and control is transferred back to the interrupted address. If the function code is valid it is analyzed to determine the proper routine to pass control to. The routines Pause 960, Killword 962, Autokern 964, Rptprt 966, Reset 968, and UNS/ULNS 970 are valid codes. Each of these routines will be discussed below.

If a data character has been received the keyin routine 950 stores the character in the print buffer 107', checks for a buffer full condition and if full issues an alarm tone, and updates the print buffer pointers. The Keyin routine 950 then returns to the address interrupted by the receipt of the keyboard interrupt.

The Pause routine 960 is entered from the Keyin routine 950 when the Pause function key 239 is depressed and causes the interrupt address to be set to the pause routine. The routine then returns to the interrupted address. The next keyboard interrupt will cause the Pause routine 960 to be entered again. The routine tests the data character for a Print code resulting from depression of Print function key 238, if valid the routine sets the keyboard interrupt address to Keyin and returns to the interrupted address. Any input that is not a Print code is ignored.

The purpose of the Pause routine 960 is to suspend printing of the printing apparatus 10 to allow the operator time to review the data printed, change the tape 16 or change a type disc 18.

The Killword routine 962 is entered from the Keyin routine and functions to erase the input buffer data back to the previous word space or to the start of the unprinted data whichever is encountered first. The Killword routine 962 returns to the interrupted address.

The Autokern routine 964 is entered from the Keyin routine and functions to enable or disable the autokern capability at the direction of the keyboard operator. The routine returns to the interrupted address.

The Rptprt routine 966 is entered from the Keyin routine and functions to indicate the end of the repeat area within the print buffer. The operator can continue to enter data after a Repeat print function has been requested and the subsequent data will be printed after the multiple copies of data have been printed. The routine stores the appropriate addresses and returns to the interrupted address.

The Reset routine 968 is entered from the Keyin routine and causes the device to be reinitialized by the Reset routines 902–905 at the beginning or end of the current or next print cycle. The routine sets the appropriate flags and returns to the interrupted address.

The UNS/ULNS routine 970 is entered from the Keyin routine and functions to update the UNS/ULNS flags and indicators, which control a type disc translate table to be used. The LED indicators 308–312 are updated on the display panel 300. The routine returns to the interrupted address.

The Keyexit1 routine 972 is entered by the various function code routines when it is necessary to reset the keyboard interrupt address to Keyin. The routine does not exit but passes control to the Keyexit2 routine 974.

The Keyexit2 routine 974 is entered by the various function code routines or the Keyexit1 routine 972. The purpose of the routine is to perform the housekeeping necessary to exit the keyboard routines and return to the address which was previously interrupted. The return will be either to the Idle routine 910 or to some position within the Print routines 911 through 928.

The print routines 911 through 928 which follow the Idle routine 910 in the flow chart can now be discussed as the process of handling keyboard interrupts and the data and function keys is now understood.

The Get print character routine 914 retrieves the next data character to be printed from the print buffer 107' and maintains the character in working registers within the microprocessor 104.

The Kern option avail routine 915 tests if the kern driver 700 is installed on the device. If it is, the Process kern routine 916 is entered; otherwise the Process kern routine 916 is bypassed and control is passed to the Update buffer routine 918.

The Process autokern routine 916 determines if kerning has been selected by the operation selection of the kern function key 234. If kerning is active the current character and the previous character are compared to a table called Krntab to determine if kerning of this character combination is required. If kerning is required a flag is set, to be tested by the Process print function routine 926. The Process autokern routine passes control to the Update buffer routine 918.

The update buffer routine 918 maintains the proper pointers for the print buffer to determine the next character to print. The routine passes control to the Process Repeat routine 920.

The Process Repeat routine 920 determines if the repeat mode is enabled and maintains special pointers to define the portion of the buffer in which the data to be repeated is stored and keeps track of the required number of copies. The Process Repeat routine 920 causes the special pointers to be reinitialized for each copy to be printed. The Process Repeat routine 920 also maintains the count of copies to be repeated. The Process Repeat routine 920 passes control to the Process type disc move calculating routine 922.

The Process type disc move calculating routine 922 determines the number of characters to move and the direction, clockwise or counterclockwise, to move. The routine then determines the number of steps necessary to pulse the stepper motor 58. The routine stores the direction and number of steps to pulse the stepper motor for use by the Process type disc positioning routine 924. The routine passes control to the Process type disc positioning routine.

The Process type disc positioning routine 924 outputs the control signals to the print output-port, pins 2, 5 and 9 of output buffer 111, which causes the type disc 18 to be positioned to the next print character. The routine issues a pulse output to the stepper motor to step clockwise or counterclockwise. The routine then calls the Timeout routine 990 to delay the predetermined amount of time for the stepper motor to complete the step. The amount of time to delay is found in a table called TDRUDT. This table has been calculated to provide the proper ramp-up, ramp-down and full speed stepper delays. The Process type disc positioning routine 924 then checks if the type disc 18 has been moved to the next print position. If not, the routine locates the next timeout value and repeats the process. The Process type disc positioning routine 924 continues this process until the type disc 18 has been properly positioned and is ready for the print function. The routine passes control to the Process print function routine 926.

The Process print function routine 926 controls the output signals necessary to cause the character to be printed. These signals are all time dependent and, as such, the routine uses the Timeout routine 990 to generate the proper delays where required. The Process print function routine 926 also controls, in the proper sequence, the stabilization of the type disc 18 by maintaining power to the stepper motor 58 until any inertial movement has abated. The routine also processes the necessary kern signals to cause automatic kerning of the previous and current character if required. The Type disc home routine 927 tests if the type disc 18 should be at home, i.e. was the last print character a word space. If the type disc 18 should be at home the routine inputs the home indicator port and determines if the type disc 18 is actually at the home position. If the type disc 18 is at home the routine passes control to the idle routine 910. If the type disc 18 is not at home the routine passes control to the Process home type disc routine 904.

The Process home type disc routine 928 causes the type disc 18 to be positioned to the home position. The type disc 18 is homed by stepping the stepper motor 58 in a clockwise direction a maximum of two thousand steps and testing the type disc-home port after each step. The type disc home port is initialized after each character is printed to allow the detection of the home position only when the last printed character was a word space (home) character and not when the type disc 18 happened to pass the home position on the way to some other print position. The "type disc home" port 162 inputs the data to the microprocessor 101 data bus from reflective sensor assembly 500 which senses the reflective tape 50 affixed to the type disc 18.

The Timeout routine 990 is called by various routines and provides the ability to perform precise delays in the processing of the device. The delays are generated by a clock timer circuit which is accurate to a few microseconds. The routine saves the address to return to when the delay is complete and initializes the clock timer circuit to begin timing. The routine then waits until it is interrupted by the clock timer circuit at which time it dispatches the interrupt by returning to the proper timer interrupt address as saved by the routine. The Timeout routine can also be interrupted by the keyboard while waiting for the timer to expire. If this happens the keyboard interrupt is processed as earlier discussed and the return from the keyboard interrupt is to the timer wait loop.

Having explained the electromechanical connections and operation of the invention and software control, the operation of the invention by an operator is exceedingly straight forward and demonstrates the achievement of an object of the invention which is ease of operation. Set forth below are the operating steps necessary to use the invention.

INITIAL TURN-ON AND NORMAL OPERATION

1. Plug power cord assembly 26 into a 110-Volt AC receptacle.
2. Mount UNS or ULNS type disc 18.
3. Press ON/OFF switch 13 to ON.
4. Observe power indicator lights 312.
5. Observe indicators 308–311 flashing on and off, indicating self-test is in progress.
6. Observe type disc 18 rotate to home position.
7. Observe ULNS indicator light, 309.
8. Observe READY indicator light, 311, indicating system is ready for keyboard input.
9. If UNS is desired, press UNS/ULNS switch 233 and observe ULNS indicator, 309, goes out and UNS indicator, 310, goes on. To return to ULNS, press switch, 233, again.
10. If automatic kerning is installed and desired, press AUTO KERN function switch, 234. Observe AUTO KERN indicator light, 308. To deactivate automatic kerning, press AUTO KERN switch 234 again.
11. Press ADVANCE function key, 235, to advance blank leader in front of printed copy, and begin entering data on the keyboard 200.
12. To correct an input error that has not already been printed, promptly depress KILL WORD function key, 236, to cancel all characters back to the last word space entered. Reenter the word correctly.
13. To reinitialize the system at any time, press RESET function key, 232.
14. After printing is completed, press ADVANCE function key, 235, twice to advance copy past cut blade and provide blank leader tape, 16.
15. To discontinue use, press ON/OFF switch 13 to OFF.

TO MAKE MULTIPLE COPIES

1. Turn system on. If already on, depress RESET function key, 232.
2. Depress REPEAT QTY function key, 237.
3. Enter number of copies desired in two digits 00 through 99. Verify that the correct count is printed on the tape, 16, followed by an automatic tape advance.
4. Enter the text to be printed. Verify that the characters displayed on the tape 16, are correct. If not, depress RESET key, 232, and return to step 2 to edit or correct the message.
5. If space is desired between copies, enter one or more word spaces, 226, or ADVANCE functions, 235.
6. Initiate printing by depressing PRINT function key, 238.
7. To interrupt printing to change discs, 18, or tape cartridges, 64, without losing the stored characters, depress PAUSE function key, 239. When ready, depress PRINT key, 238, to resume printing; or RESET key, 232, to return to normal keyboard input.

8. To repeat the same number of copies of the same message, press PRINT function key, 238, again. Pressing any other key first disables this capability, and returns the keyboard to normal operation.

CHANGING TYPE DISCS

1. Upon replacing the type disc, press RESET key, 232, to cause the disc, 18, to be automatically driven to the home position.
2. If the disc, 18, type has been changed depress UNS-/ULNS function key, 233, and observe UNS-,ULNS indicator lights, 310, 309.

Although the present invention has been described with reference to a preferred embodiment, those skilled in the art will recognize that changes may be made in form and detail without departing from the spirit and scope of the invention. For example, the commercially available components may be interchangeable with components which perform similar functions or certain of components may be combined or incorporated into the microcomputer 101 functions. For example, if sufficient memory exists in the digital processor, 100, the digital processor, 100, could perform the function of the stepper motor translator, 140. Also, other means could be used to enter data into the microprocessor and other peripheral output devices could be utilized.

These modifications and variations may be resorted to without departing from the spirit of the invention as those skilled in the art will readily understand. Such modifications and variations are considered to be within the purview and scope of the present invention as decribed by the following claims.

Having described our invention, we claim:

1. In a tape lettering or printing apparatus for lettering or printing characters on a tape comprising a tape printing station, a circular rotatable front for providing a raised character in printing alignment at the tape printing station and means for printing characters on the tape in a tape print cycle, including a means for providing a color carrying ribbon and image carrying tape at the tape printing station, a means for advancing the ribbon and tape in alignment with the tape printing station, and a force generating means for exerting a printing force to print characters on the tape at the tape printing station, and wherein the means for printing characters on the tape further comprises a print motor for operating the tape printing apparatus during the tape print cycle, the improvement comprising:

processing means for receiving input data to be printed on the tape and for supplying control signals to the tape printing apparatus to cause the tape printing apparatus to print the input data on the tape;

data input means connected to the processing means for entering input data and transmitting the data in encoded form to the processing means so that the data can be sequentially printed on the tape;

a character positioning motor, operatively connected to the circular rotatable font, for rotating the circular font to provide a raised character at the tape printing station;

character positioning motor control means for causing, in response to receipt of control signals from the processing means, the character positioning motor to rotate and position the font from its present position to a selected character position so that a selected character to be printed on the tape is presented at the tape printing station;

means for deenergizing the character positioning motor prior to aligning the character to be printed on the tape;

print motor control means for causing, in response to control signals from the processing means, the tape print cycle to occur so that the color carrying ribbon and image carrying tape are provided at the tape printing station, the selected character to be printed on the tape is aligned for printing and a printing force is exerted against the color carrying ribbon, the tape and the character on the circular font at the tape printing station so that an image of the character is transferred from the coloar carrying ribbon to the image carrying tape; and means enabling the simultaneous entry and printing of data and permitting the rate of data entry to exceed the rate of printing, said enabling means including processing means which comprises:

a multiple character input buffer for receiving coded data from the input means at the data rate of the input means;

a programmed microcomputer for sequentially decoding the data in the input buffer and for calculating the amount of rotation of the circular rotatable font necessary to sequentially print each successive character on the tape;

an output buffer connected to and controlled by the programmed microcomputer and connected to control with control signals the character positioning motor through the character positioning motor control means and the print motor through the print motor control means in the sequence programmed into the microcomputer so that each character on the circular rotatable font corresponding to a character entered by the data input means is sequentially positioned at the tape printing station and a tape print cycle is initiated and concluded for each character so that data can be printed on the tape at the printing rate of the tape printing apparatus and subsequent data can be simultaneously entered into said input buffer; and wherein the character positioning motor control means and the print motor control means each comprise means for converting the logic level signals of the processing means into power level signals sufficient to operate the character positioning motor and the print motor, respectively.

2. The improvement of claim 1 wherein the processing means comprises a programmable, digital processing means having memory means for storing input data to be printed on the tape and control information, the control information including a stored program for directing control functions to be performed, and wherein the programmable, digital processing means is connected to the character positioning motor control means and the print motor control means for supplying control signals to the tape printing apparatus as a function of the control information.

3. The improvement of claim 1 wherein the means for entering data to be printed on the tape is an input keyboard.

4. The improvement of claim 3 wherein the keyboard has keys, each associated with a character to be printed, and wherein the layout of the keys on the keyboard is substantially similar to the layout of keys on a conventional typewriter.

5. The improvement of claim 3 wherein the circular font for providing a raised character for printing on the tape at the tape printing station comprises a removable disc so that a plurality of different styles or sizes of characters can be selectively printed on the tape by the tape printing apparatus and wherein the keyboard further comprises a plurality of removable panels to be inserted over the keys of the keyboard, each panel having indicia subscribed thereon which corresponds to characters on the selected removable disc whereby the keyboard can be adapted to correspond to the selected removable disc mounted on the tape printing apparatus.

6. The improvement of claim 1 further comprising:
an audible transducer for emitting an audible signal;
audible alarm control means for causing, in response to control signals from the digital processing means, the audible transducer to emit a warning sound when the buffer has been filled to a selected number of characters to be printed on the tape; and
wherein the programmable, digital processing means comprises means for keeping track of the number of characters entered into the multiple character buffer and means for providing a control signal to the audible alarm control means when a selected number of characters to be printed on the tape have been entered into the multiple character buffer.

7. The improvement of claim 2 wherein the means for entering data is an input keyboard and wherein the keyboard comprises a plurality of function keys connected to the programmable, digital processing means, each function key corresponding to a selected function to be performed by the tape printing apparatus, and wherein the programmable, digital processing means comprises means for analyzing which function key has been depressed and means for causing control signals to be connected to the tape printing apparatus to execute the selected function corresponding to the selected function key.

8. The improved printing apparatus of claim 1 wherein the circular rotatable font for providing a raised character for printing at the printing station comprises a rotatable disc having raised embossed characters thereon and wherein the character positioning motor comprises means for rotating the disc so that the selected character is provided at the tape printing station.

9. The improvement of claim 8 wherein the rotating means are rotated clockwise or counterclockwise in response to control signals from the processing means so that the disc rotates the shortest distance between the previous character printed on the tape and the next character to be printed on the tape.

10. The improvement of claim 8 wherein the character positioning motor comprises:
a stepper motor on-off control connected to the processing means;
a stepper motor translator circuit connected to the processing means;
a stepper motor connected to the stepper motor on-off control and the stepper motor translator circuit; and
a rotatable gear operatively connected to the stepper motor and positioned to engage the rotatable disc to rotate it so that the selected character to be printed on the tape is positioned at the tape printing station.

11. The improvement of claim 2 wherein the programmable, digital processing means comprises timing means as part of the control information and wherein operation of the character positioning motor is accomplished with a timed sequence of control signals from the programmable, digital processing means.

12. The improvement of claim 2 wherein the programmable, digital processing means comprises timing means as part of the control information and wherein operation of the print motor is accomplished with a timed sequence of control signals from the programmable, digital processing means.

13. The improvement of claim 7 wherein at least one of the function keys causes a repeat function to be performed wherein a selected number of identical tapes can be produced by the tape printing apparatus based on one set of data entered on the input means.

14. The improvement of claim 2 wherein the tape printing apparatus can be operable or nonoperable and when operable can be operated in different modes of operation and wherein the programmable, digital processing means comprises means for monitoring the operational status of the tape printing apparatus and wherein the improvement further comprises means for visually displaying the operational status of the tape printing apparatus.

15. The improvement of claim 14 wherein the means for visually displaying the operational status of the tape printing apparatus comprises:
a plurality of LEDs mounted on the means for entering input data whereby the operational status of the tape printing apparatus can be visually observed while entering data to be printed on the tape.

16. The improvement of claim 2 further comprising:
means for sensing the position of the circular rotatable font connected to the programmable processing means and wherein at least one of the control signals from the digital processing means to the character positioning motor is a function of the position of the rotatable font as sensed by the sensing means.

17. The improvement of claim 16 wherein the circular rotatable font has a preselected position as a designated home position from which all character positions can be referenced and wherein one of the control signals from the digital processing means comprises a control signal to the character positioning motor control means to automatically rotate the font to the designated home position.

18. The improvement of claim 16 wherein the sensing means is an optical sensing means and wherein the position of the circular rotatable font is periodically sensed by the optical sensing means to determine if the font is in the correct alignment to print the selected characters on the tape and wherein the programmable, digital processing means interrupts the printing of data on the tape if the optical sensing means indicates the circular rotatable font is out of alignment and issues a control signal to the character positioning motor control means to realign the circular rotatable font prior to printing the next character on the tape.

19. The improvement of claim 1 wherein the improvement further comprises means for enhancing the quality of lettering by automatically controlling the spacing between certain combinations of individual printed characters.

20. In a tape lettering or printing apparatus for lettering or printing characters on a tape comprising a tape printing station, a circular rotatable font for providing a raised character in printing alignment at the tape printing station and means for printing characters on the tape in a tape print cycle, including a means for providing a color carrying ribbon and image carrying tape at the tape printing station, a means for advancing the ribbon and tape in alignment with the tape printing station, and a force generating means for exerting a printing force to print characters on the tape at the tape printing station, and wherein the means for printing characters on the tape further comprises a print motor for operating the tape printing apparatus during the tape print cycle, the improvement comprising:

processing means for receiving input data to be printed on the tape and for supplying control signals to the tape printing apparatus to cause the tape printing apparatus to print the input data on the tape;

data input means connected to the processing means for entering input data to be printed on the tape;

character positioning motor, operatively connected to the circular rotatable font, for rotating the circular font to provide a raised character at the tape printing station;

character positioning motor control means for causing, in response to receipt of control signals from the processing means, the character positioning motor to rotate and position the font from its present position to a selected character position so that a selected character to be printed on the tape is presented at the tape printing station;

means for deenergizing the character positioning motor prior to aligning the character to be printed on the tape;

print motor control means for causing, in response to control signals from the processing means, the tape print cycle to occur so that the color carrying ribbon and image carrying tape is provided at the tape printing station, the selected character to be printed on the tape is aligned for printing and a printing force is exerted against the color carrying ribbon, the tape and the character on the circular font at the tape printing station so that an image of the character is transferred from the color carrying ribbon to the image carrying tape; and means for enhancing the quality of lettering by automatically controlling the spacing between certain combinations of individual printed characters, the means for enhancing comprising:

an electromagnetic solenoid connected to the means for providing a color carrying ribbon and image carrying tape at the tape printing station to adjust the position of the image carrying tape prior to the time that the print motor control means causes a tape print cycle to occur if one of the certain combinations of individual printed characters is being printed on the tape.

21. The improvement of claim 2 wherein the control information comprises a table of stored data which contains a plurality of pairs of various shaped characters requiring kerning and where in the improvement further comprises a tape advancing means, connected to the programmable, digital processing means and to the means for providing the color carrying ribbon and image carrying tape at the tape printing station, for advancing the tape in a kerning relationship, said means being responsive to a control signal from the programmable, digital processing means which is a function of the table of characters to be printed on the tape which require kerning.

22. The improvement of claim 2 wherein data to be printed on the tape is entered in message units and wherein the improvement further comprises means for editing the message to be printed on the tape.

23. The improvement of claim 22 wherein the means for entering data to be printed on the tape is an input keyboard and wherein the keyboard comprises at least one function key to edit the message to be printed on the tape.

24. The improvement of claim 23 wherein the data to be printed on the tape is stored in a multiple character buffer and wherein the function key operates to delete the previous message unit from the multiple character buffer.

25. The improvement of claim 22 wherein the improvement further comprises means for displaying the message to be printed on the tape.

26. The improvement of claim 25 wherein the stored program includes a software routine to print a plurality of tapes, each having the same message imprinted thereon, and wherein the means for displaying the message to be printed on the tape comprises a software routine which causes the tape printing apparatus to preprint the message on the tape prior to printing the plurality of tapes and the means for editing the message to be printed on the tape comprises a series of software routines which permit the message to be reentered into the programmable, digital processing means prior to printing the plurality of tapes.

27. The improvement of claim 2 wherein the circular rotatable font for providing a raised character for printing at the tape printing station comprises a removable disc so that a plurality of different styles of sizes of characters can be selectively printed by the tape printing apparatus and wherein the control information comprises a plurality of tables stored by the programmable, digital processing means, each table corresponding to a selected type disc and wherein the means for entering data to be printed on the tape comprises at least one function key connected to the programmable, digital processing means, said function key corresponding to a selected type disc and table, and wherein the programmable, digital processing means comprises means for analyzing whether the function key has been depressed and means for causing control signals to be connected to the tape printing apparatus to print characters on the tape which correspond to the selected type disc.

28. The improvement of claim 7 wherein input data to be printed on the tape is stored in a multiple character buffer and wherein one of the function keys comprises a function key to selectively stop the tape printing apparatus from printing characters on the tape which are stored by the programmable, digital processing means in the multiple character buffer.

29. The improvement of claim 28 wherein another of the function keys comprises a function key for causing the tape printing apparatus to resume printing characters on the tape which are stored in the multiple character buffer without loss of data.

30. In a tape lettering or printing apparatus comprising a tape printing station, a circular rotatable font for providing a raised character for printing on the tape at the tape printing station and means for printing a tape in a tape print cycle, including a means for providing a color carrying ribbon and image carrying tape at the tape printing station, a means for precisely aligning the raised character for printing on the tape at the tape printing station, a force generating means for exerting a printing force at the tape printing station, and means for advancing the tape and ribbon into printing alignment at the tape printing station, and wherein the means for printing a tape further comprises a print motor for operating the tape printing apparatus during the print cycle, the improvement comprising:

a programmable, digital processing means for storing input data to be printed on the tape and control information, the control information including a stored program for directing control functions to be performed and for supplying control signals to the tape printing apparatus as a function of the control information;

means connected to the digital processing means for entering coded input data to be printed on the tape;

character positioning motor, operatively connected to the circular rotatable font, for positioning the font to provide a raised character to be printed on the tape at the tape printing station;

character positioning motor control means for causing, in response to receipt of control signals from the digital processing means, the character positioning motor to rotate and position the circular rotatable font from its present position to a selected character position so that a selected character to be printed on the tape is presented at the tape printing station; and print motor control means for causing, in response to control signals from the digital processing means, the tape print cycle to occur so that the ribbon and tape providing means provides the color carrying ribbon and image carrying tape at the tape printing station, the character aligning means precisely aligns the selected raised character to be printed on the tape at the tape printing station, the force generating means exerts a printing force at the tape printing station, and the means for advancing the tape and ribbon advances the tape and ribbon into printing alignment at the tape printing station to receive the next character to be printed on the tape; and means enabling the simultaneous entry and printing of data and permitting the rate of data entry to exceed the rate of printing, said enabling means including programmable digital processing means which comprises:

a multiple character input buffer for receiving coded data from the input means at the data rate of the input means;

a programmed microcomputer for sequentially decoding the data in the input buffer and for calculating the amount of rotation of the circular rotatable font necessary to sequentially print each successive character on the tape;

an output buffer connected to and controlled by the programmed microcomputer and connected to control with control signals the character positioning motor through the character positioning motor control means and the print motor through the print motor control means in the sequence programmed into the microcomputer so that each character on the circular rotatable font corresponding to a character entered by the data input means is sequentially positioned at the tape printing station and a tape print cycle is initiated and concluded for each character so that the data is printed on the tape at the printing rate of the tape printing apparatus and subsequent data can be simultaneously entered into said input buffer; and wherein the character positioning motor control means and the print motor control means each comprise means for converting the logic level signals of the microcomputer into power level signals sufficient to operate the character positioning motor and the print motor, respectively.

31. In a tape lettering or printing apparatus comprising a tape printing station, a circular rotatable font for providing a raised character for printing on the tape at the tape printing station and means for printing a tape in a tape print cycle, including a means for providing a color carrying ribbon and image carrying tape at the tape printing station, a means for precisely aligning the raised character for printing on the tape at the tape printing station, a force generating means for exerting a printing force at the tape printing station, and means for advancing the tape and ribbon into printing alignment at the tape printing station, and wherein the for printing a tape further comprises a print motor means for operating the tape printing apparatus during the print cycle, the improvement comprising:

a programmable, digital processing means for storing input data to be printed on the tape and control information, the control information including a stored program for directing control functions to be performed and for supplying control signals to the tape printing apparatus as a function of the control information;

means connected to the digital processing means for entering input data to be printed on the tape;

character positioning motor, operatively connected to the circular rotatable font, for positioning the font to provide a raised character to be printed on the tape at the tape printing station;

character positioning motor control means for causing, in response to receipt of control signals from the digital processing means, the character positioning motor to rotate and position the circular rotatable font from its present position to a selected character position so that a selected character to be printed on the tape is presented at the tape printing station;

print motor control means for causing, in response to control signals from the digital processing means, the tape print cycle to occur so that the ribbon and tape providing means provides the color carrying ribbon and image carrying tape at the tape printing station, the character aligning means precisely aligns the selected raised character to be printed on the tape at the tape printing station, the force generating means exerts a printing force at the tape printing station, and the means for advancing the tape and ribbon advances the tape and ribbon into printing alignment at the tape printing station to receive the next character to be printed on the tape;

visual display means connected to the programmable digital processing means for visually displaying the operational status of the tape printing apparatus;

sensing means for optically sensing the position of the circular rotatable font, connected to the programmable processing means, so that at least one of the control signals from the digital processing means to the character positioning motor is a function of the position of the circular rotatable font as sensed by the optical sensing means;

software means to cause the programmable digital processing means to emit a control signal to the character positioning motor control means to automatically position the circular rotatable font to a designated home position;

kerning means connected to the means for providing a color carrying ribbon and image carrying tape at the tape printing station for enhancing the quality of lettering by automatically controlling the spacing between certain combinations of individual characters printed on the tape; and wherein the means for entering input data to be printed on the tape further comprises a plurality of function keys connected to the programmable, digital processing means, each function key corresponding to a selected function of the tape printing apparatus, and wherein the programmable, digital processing means comprises software means as part of the control information for analyzing which function key has been depressed and means for causing control signals to be connected to the tape printing apparatus to execute the selected function corresponding to the selected function key.

32. The improvement of claim 30 wherein the programmable, digital processing means comprises timing means as part of the control information and wherein the character positioning motor is deenergized at a time prior to the time that the print motor is energized to print a character on the tape so that the circular rotatable font for providing a raised character to be printed on the tape can be precisely aligned at the tape printing station.

33. The improvement of claim 32 wherein the character positioning motor is a variable reluctance motor.

34. An input and control device for a tape printing machine having a rotatable character font mounted on top of the machine for printing a single line of characters on a tape, comprising:

an input keyboard to enter characters to be printed on the tape;

a multiple character data buffer memory means for storing the sequence of characters to be printed on the tape typed on the input keyboard;

a computer program for determining which keys on the keyboard have been depressed and for determining the sequence of movement for the character font so that the sequence of characters that have been stored in the data buffer will be printed on the tape;

a second memory means for storing the computer program;

a digital microprocessor connected to the memory means and the tape printing machine and controlled by the computer program for calculating the amount of rotation of the circular rotatable font necessary to sequentially print each successive character on the tape and for issuing control signals to cause the sequence of characters stored in the data buffer to be sequentially printed in a single line on the tape by the tape printing machine;

a motor electrically connected to the microprocessor and operatively connected to the character font for sequentially rotating the character font to the sequence of characters in the data buffer for purposes of printing the characters on the tape;

motor control means electrically connecting the motor and the digital microprocessor; and means enabling the simultaneous entry and printing of data and permitting the rate of data entry to exceed the rate of printing, said enabling means including an output buffer connected to and controlled by the digital microprocessor and connected to control with control signals the motor through the motor control means in the sequence programmed into the microprocessor that each character on the rotatable character font corresponding to a character entered on the input keyboard is sequentially positioned and a tape print cycle is initiated and concluded for each character so that the characters are printed on the tape at the printing rate of the tape printing machine and subsequent data can be simultaneously entered into said data buffer; and wherein the motor control means comprises means for converting the logic level signals of the microprocessor into power level signals sufficient to operate the motor.

35. An automated tape lettering machine for printing a line of characters on a tape, comprising:

an input keyboard to enter characters to be printed on the tape;

a multiple character data buffer memory for storing the sequence of characters entered on the input keyboard so that characters can be entered at a faster rate than the characters are printed on the tape;

a rotatable and selectively removable character font mounted on the tape lettering machine, the character font having a plurality of raised characters thereon corresponding to the characters on the input keyboard;

a programmed microcomputer for determining which keys on the keyboard have been depressed, for storing the characters in the data buffer, for determining which characters remain in the data buffer to be printed on the tape, for calculating the amount of rotation of the circular rotatable font necessary to sequentially print each successive character on the tape, and for controlling the sequence of movement of the character font so that the sequence of characters stored in the data buffer is sequentially printed on the tape;

a tape printing station for printing characters on the tape;

means for providing a tape to be printed at the printing station and a color carrying ribbon to print characters on the tape;

character positioning motor electrically connected to and controlled by the microcomputer and operatively connected to the character font for sequentially rotating the character font to the sequence of characters in the data buffer;

character positioning control means connected to the microcomputer and the character positioning motor;

force generating means electrically connected to and controlled by the microprocessor for exerting a printing force at the tape printing station to transfer the raised character image on the character font from the color carrying ribbon to the tape being printed;

force generating control means connected to the microcomputer and the force generating means;

means enabling the simultaneous entry and printing of data and permitting the rate of data entry to exceed the rate of printing, said enabling means including an output buffer connected to and controlled by the programmed microcomputer and connected to control with control signals the character positioning motor through the character positioning motor control means and the force generating means through the force generating control means in the sequence programmed into the microcomputer so that each character on the circular rotatable font corresponding to a character entered by the data input means is sequentially positioned at the tape printing station and a tape print cycle is initiated and concluded for each character so that the data is printed on the tape at the printing rate of the tape lettering machine and subsequent data can be simultaneously entered into said data buffer; and wherein the character positioning motor control means and the force generating control means each comprise means for converting the logic level signals of the microcomputer into power level signals sufficient to operate the character positioning motor and the force generating means, respectively.

36. A keyboard actuated tape lettering or printing apparatus having a tape printing station for printing a line of characters on a tape comprising:

an input keyboard having a plurality of keys, each with a character thereon;

a programmed microprocessor connected to the keyboard to cause characters entered on the keyboard to be printed on the tape;

a rotatable font having a plurality of raised characters thereon for providing a raised character in printing alignment at said tape printing station;

motor electrically connected to and controlled by the microprocessor and operatively connected to the rotatable font to rotate the correct raised character to the tape printing station;

means for providing a color carrying ribbon and an image carrying tape at said tape printing station, said ribbon and tape providing means comprising:

advancement means for advancing said ribbon and tape into printing alignment at said tape printing station, said advancement means including a cartridge carrier movable reciprovally toward and away from said tape printing station;

a tape-ribbon cartridge containing a supply of ribbon and tape adapted for insertion into said cartridge carrier for movement therewith forward and away from said tape printing station; and force generating means connected to and controlled by said microprocessor for exerting a printing force at said tape printing station to transfer an image of said raised character from said ribbon to said tape; and means enabling the simultaneous entry and printing of data and permitting the rate of data entry to exceed the rate of printing, said enabling means including a programmed microprocessor which comprises:

a multiple character input buffer for receiving coded data from the input keyboard at the data rate of the operator;

a programmed microcomputer for sequentially decoding the data in the input buffer and for calculating the amount of rotation of the rotatable font necessary to sequentially print each successive character on the tape;

an output buffer connected to and controlled by the programmed microcomputer and connected to control with control signals the motor and the force generating means in the sequence programmed into the microcomputer so that each character on the circular rotatable font corresponding to a character entered by the data input means is sequentially positioned at the tape printing station and a tape print cycle is initiated and concluded for each character so that the data is printed on the tape at the printing rate of the tape printing apparatus and subsequent data can be simultaneously entered into said input buffer; and means for converting the logic level signals of the microprocessor into power level signals sufficient to operate the motor and the force generating means, respectively.

* * * * *

UNITED STATES PATENT AND TRADEMARK OFFICE

CERTIFICATE OF CORRECTION

PATENT NO. : 4,462,708

DATED : July 31, 1984

INVENTOR(S) : Cleto R. Luartes and William H. Powell, Jr.

It is certified that error appears in the above-identified patent and that said Letters Patent is hereby corrected as shown below:

In column 14, line 34, delete "drive" and insert --driver--

In column 15, line 37, delete "unitl" and insert --until--

In column 21, line 40, delete "front" and insert --font--

In column 22, line 17, delete "coloar" and insert --color--

In column 22, line 23, insert --the-- after "including"

In column 23, line 15, claim 6, delete "l" and insert --2--

In column 25, line 21, claim 20, insert --a-- before "character"

In column 26, line 35, claim 27, delete "of" and insert --or--

In column 27, line 18, claim 30, insert --a-- before "character"

In column 27, line 47, claim 30, insert --the-- after "including"

In column 28, line 22, claim 31, insert --means-- after "wherein the"

In column 28, line 23, claim 31, delete "means"

In column 28, line 36, claim 31, insert --a-- before "character"

In column 30, line 11, claim 34, insert --so-- after "microprocessor"

UNITED STATES PATENT AND TRADEMARK OFFICE

CERTIFICATE OF CORRECTION

PATENT NO. : 4,462,708

DATED : July 31, 1984

INVENTOR(S) : Cleto R. Luartes and William H. Powell, Jr.

It is certified that error appears in the above-identified patent and that said Letters Patent is hereby corrected as shown below:

In column 30, line 53, claim 35, insert --a-- before "character"

In column 30, line 58, claim 35, insert --motor-- after "positioning"

In column 30, line 62, claim 35, delete "microprocessor" and insert --microcomputer--

In column 31, line 40, claim 36, insert --a-- before "motor"

In column 32, line 18, claim 36, delete "a" and insert --the--

Signed and Sealed this

*Eighteenth* Day of *February 1986*

[SEAL]

*Attest:*

DONALD J. QUIGG

*Attesting Officer*

*Commissioner of Patents and Trademarks*

REEXAMINATION CERTIFICATE (740th)

United States Patent [19] [11] B1 4,462,708

Luartes et al. [45] Certificate Issued Aug. 4, 1987

[54] AUTOMATED TAPE LETTERING MACHINE

[75] Inventors: Cleto R. Luartes, Burnsville; William H. Powell, Jr., Stillwater, both of Minn.

[73] Assignee: Kroy Inc., Scottsdale, Ariz.

Reexamination Reqs:st:
No. 90/000,966, Mar. 7, 1986
No. 90/001,029, Jun. 6, 1986

Reexamination Certificate for:
Patent No.: 4,462,708
Issued: Jul. 31, 1984
Appl. No.: 252,699
Filed: Apr. 8, 1981

Certificate of Correction issued Feb. 18, 1986.

[51] Int. Cl.[4] ..... B41J 1/30; B41J 3/30

[52] U.S. Cl. ..... 400/304; 400/52; 400/63; 400/130; 400/154.5; 400/479

[58] Field of Search ..... 400/4, 63, 130, 154.5, 400/486–489, 304, 712, 50, 14, 479, 52, 144.2, 144.3, 303, 306

[56] References Cited

U.S. PATENT DOCUMENTS

| | | | |
|---|---|---|---|
| Re. 30,785 | 10/1981 | Lovercheck | 364/200 |
| 2,907,004 | 9/1959 | Chien . | |
| 3,236,352 | 2/1966 | Schacht | 400/611 X |
| 3,282,389 | 11/1966 | Rudisch . | |
| 3,712,443 | 1/1973 | Matthews | 400/304 |
| 3,750,791 | 8/1973 | McReynolds . | |
| 3,823,389 | 7/1974 | Heitman | 400/63 X |
| 3,861,299 | 1/1975 | Drillick | 101/18 |
| 3,872,444 | 3/1975 | Cleveland . | |
| 3,872,960 | 3/1975 | Gabor | 400/320 |
| 3,892,915 | 7/1975 | Budworth | 178/21 |
| 3,912,064 | 10/1975 | Blum | 400/134.6 |
| 3,913,721 | 10/1975 | Koplow | 400/63 |
| 3,924,722 | 12/1975 | Wienhold | 340/365 R X |
| 3,946,663 | 3/1976 | Engeriser | 101/3 R |
| 3,952,289 | 4/1976 | Baligant | 340/172.5 |
| 3,954,163 | 5/1976 | Gabor | 400/144.2 |
| 3,963,340 | 6/1976 | Gerace | 355/3 R |
| 3,973,244 | 8/1976 | Lovercheck | 364/900 |
| 3,974,906 | 8/1976 | Lee | 400/196.1 |
| 3,978,328 | 8/1976 | Fabry | 235/156 |
| 3,981,383 | 9/1976 | Bittner | 400/712 X |
| 3,986,011 | 10/1976 | Poole | 235/151.22 |
| 4,005,772 | 2/1977 | Kieffer | 400/903 X |
| 4,007,443 | 2/1977 | Bromberg | 340/365 S |
| 4,015,700 | 4/1977 | Paque | 400/617 |
| 4,016,365 | 4/1977 | Staar | 178/23 R |
| 4,024,447 | 5/1977 | Epstein | 400/903 X |
| 4,030,591 | 6/1977 | Martin | 400/144.2 |
| 4,050,565 | 9/1977 | Heider | 400/130 |
| 4,071,131 | 1/1978 | Turek | 101/93.02 |
| 4,074,798 | 2/1978 | Berger | 400/144.2 |
| 4,087,852 | 5/1978 | Campbell | 364/200 |
| 4,091,910 | 5/1978 | Bolton | 400/131 |
| 4,091,911 | 5/1978 | Chang | 400/70 |
| 4,103,766 | 8/1978 | Ruble | 400/144.2 |
| 4,108,556 | 8/1978 | Connoy | 400/48 |
| 4,118,129 | 10/1978 | Grundherr | 400/144.2 |
| 4,119,839 | 10/1978 | Beckmann et al. | 235/145 R |
| 4,121,228 | 10/1978 | Cowe | 354/7 |
| 4,138,719 | 2/1979 | Swanstrom et al. | 364/200 |
| 4,142,140 | 2/1979 | Weisner | 318/696 |
| 4,145,742 | 3/1979 | Olander | 364/709 |
| 4,153,940 | 5/1979 | Grier | 340/711 |
| 4,158,130 | 6/1979 | Speraw | 235/146 |

(List continued on next page.)

FOREIGN PATENT DOCUMENTS

| | | | |
|---|---|---|---|
| 0047018 | 3/1982 | European Pat. Off. . | |
| 2448439 | 9/1980 | France | 400/144.2 |

OTHER PUBLICATIONS

*Dictionary of Printing Terms*, 5th Ed., 1950; Porte Publishing Co., p. 91.

*Authors and Printers Dictionary*, 11th Ed., F. Howard Collins; Oxford University Press, London (1973), pp. 230–231.

*Dictionary of Graphic Arts Terms*, Patricia Barnes Mintz, 1981; Van Nostrand Reinhold Company, pp. 125–126.

Various schematic drawings from *Spinwriter Maintenance Manual*, (c) 1978, NEC Information Systems, Inc.

Brochure: "Meet the Pro:", Cherry Electrical Products Corp.

*National Semiconductor TTL Data Book*, (c) 1976, National Semiconductor Corp., pp. 2–98, 2–99, 2–100, 2–187, 2–182.

*Z80–Assembly Language Programming Manual*, Apr. 1980, Zilog, Inc., Campbell, California.

*Spinwriter Maintenance Manual*, NEC Information Systems, Inc., copyright 1979.

(List continued on next page.)

*Primary Examiner*—Paul T. Sewell

[57] ABSTRACT

An improved dry lettering printing machine of the type having a printing station, a rotatable disc or type font having embossed characters on the disc and a means for causing the machine to execute a print cycle which includes providing a color carrying ribbon and image carrying tape at the print station, precisely aligning a selected raised character on the disc for printing, exerting a printing force at the printing station, and reciprocating the tape cartridge to advance the tape and ribbon to print the next character at the printing station. The improvement includes an input keyboard for typing the information which is to appear on the tape interfaced with the printing machine with a programmed microcomputer which stores the input data and, with control signals, sequentially causes the printing machine to print a tape according to the information typed on the keyboard. The improvement further includes a means for electromechanically rotating the disc or type font in either a clockwise or counterclockwise direction, whichever is shorter, to position the next character for printing which enhances the speed and automatic operation of the improved machine. A number of function keys and indicators are also provided on the keyboard to further enhance the speed and ease of operation of the printing machine.

U.S. PATENT DOCUMENTS

| | | | |
|---|---|---|---|
| 4,179,732 | 12/1979 | Khan | 364/200 |
| 4,180,338 | 12/1979 | LaManna | 400/582 |
| 4,195,338 | 3/1980 | Freeman | 364/200 |
| 4,195,938 | 4/1980 | Velazquez | 400/124 |
| 4,198,169 | 4/1980 | Stulber | 400/144.2 |
| 4,204,779 | 5/1980 | Lee | 400/144.2 |
| 4,215,943 | 8/1980 | Lau | 400/161.1 |
| 4,220,417 | 9/1980 | Sprott | 400/70 |
| 4,222,102 | 9/1980 | Jansen | 364/200 |
| 4,225,249 | 9/1980 | Kettler et al. | 400/3 |
| 4,235,554 | 11/1980 | Yamada | 400/52 |
| 4,243,333 | 1/1981 | Bradshaw et al. | 400/158 |
| 4,259,025 | 3/1981 | Jamieson | 400/18 |
| 4,264,217 | 4/1981 | De Sieno | 400/63 |
| 4,271,012 | 6/1981 | LaManna | 209/653 |
| 4,277,191 | 7/1981 | Davis | 400/582 |
| 4,279,523 | 7/1981 | Ringle | 400/279 |
| 4,314,769 | 2/1982 | James | 400/144.2 |
| 4,320,980 | 3/1982 | Mia | 400/70 |
| 4,323,315 | 4/1982 | Demonte et al. | 400/63 |
| 4,334,286 | 6/1982 | Kerigan | 364/900 |
| 4,335,940 | 6/1982 | Morgan | 354/8 |
| 4,335,941 | 6/1982 | Moyroud | 354/15 |
| 4,338,034 | 7/1982 | Babler | 400/144.2 |
| 4,346,445 | 8/1982 | Luenberger | 364/520 |
| 4,355,913 | 10/1982 | Rutkowski, Jr. | 400/63 |
| 4,384,795 | 5/1983 | Lutes | 400/77 |
| 4,464,069 | 8/1984 | Yamada | 400/83 |
| 4,497,589 | 2/1985 | Figini | 400/706 |
| 4,500,216 | 2/1985 | Demonte | 400/8 |
| 4,548,519 | 10/1985 | Schroeder | 400/61 |

OTHER PUBLICATIONS

*Spinwriter Theory of Operation Manual,* NEC Information Systems, Inc., copyright 1978.

*The TTL Data Book for Design Engineers,* Second Edition, Texas Instruments Incorporated, copyright 1981, (pp. 7.471-7.477 & 7.253-7.258).

*Intel 1977 Data Catalog,* Intel Corporation, 1977, (pp. 10-43 thru 10-51; and pp. 10-170 thru 10-191).

"800 ETS Magcard Operator Manual," Xerox, 1979, Chapter 4, pp. 3-7.

"800 ETS Magcard Reference Guide," Xerox, 1979, pp. 3/1-3/5.

"Computer-to-Selectric Interface, Part I," Radio Electronics, Apr. 1981.

"Computer-to-Selectric Interface, Part II," Radio Electronics, May 1981.

"Carousel Printer Produces Sharp, Clear Letters," Product Engineering, Apr. 1975.

"Character Wheel for Low-Cost Changeable Font Printer," IBM, Oct. 1973.

"Computer Label Preparation System Involves Material Handling Efficiency," Food Engineering, Jul. 1981.

"Direct Punch for Buffered Key Entry Device,", IBM, Apr. 1972.

"Electronic Teleprinters Lo 2000," Cramer, ITT, 1976, Electrical Communication, vol. 51, No. 3, 1976, pp. 189-193.

"Electronics in Teleprinters," Eissfeld, Siemens, Jul. 1978, pp. 20-23.

"ITT 2300 Teleprinter," Evans, ITT, 1975.

"Low Cost Computerized Labeling Saves Production Time," Assembly Engineering, Sep. 1979.

"LSI Design of a Stand-Alone Machine," Randell, IBM, Feb. 1974.

"LS 120 DecWriter III Technical Manual," DEC, Dec. 1977.

"The Mechanism of a Modern Teleprinter," Von-Brown, Teletype, Jul. 1978.

"Microprocessor-Control Printer Used Step Motors For Character Selection," Computer Design, Mar. 1975.

"New 200 Bits/Sec. Keyboard Printer," Nakagawa, NTT, Nov. 1973; Apr. 1975; May 1973. 1976.

"Office Automation and New Telex Terminal," Konishi, Jan. 1979.

Smart Interface Adds Control Functions to Daisy--Wheel Printers," Daisy-Brain, Jun. 1980, *Electronics.*

"Solid State Typewriter Employs Remote LCD," Static-Typer, Aug. 1979, *Design News.*

"Spinwriter Terminal Operators Guide," NEC, May 1981.

"Spinwriter Terminals Product Description," NEC, Dec. 1980.

"Spinwriter Theory of Operation Manual," NEC. Aug. 1978.

"Technology Trends in Printers," New Electronics, Aug. 1979.

"The Teleprinter Model 1000," Siemens, Sep. 1976.

"Teleprinter Terminal Survey," Datamation, May 1978.

"Trends in Computer Printer Technology," Computer Design, Jan. 1979.

"300 Bits/Sec. Keyboard Printer," Takano, NTT, Oct. 1977.

"Word Processor Starts With a Typewriter," Electronics, Jun. 1980.

"Xerox Debuts Smart Typewriter," Electronics, Oct. 1974.

"Your Own Computer," Radio Electronics, Mar. 1979.

"LSI 120 DEC Writer III User's Manual," DEC, Oct. 1978.

"Spinwriter Maintenance Manual," NEC, Dec. 1980.

"Step Motor Control of a Daisy Wheel Printer," Kvo & Meyer, May 1978.

"Carousel Terminal Series Maintenance Manual," Perkin-Elmer Data Systems, Publication 59300-0004-03, Jun. 1977.

"800 Electronic Typing System Operator Manual Magnetic Card", Xerox Corporation, 1979, Chapter 4, pp. 3-7.

"800 Electronic Typing System Reference Guide Magnetic Card", Xerox Corporation, pp. 3/1-3/5.

"Microcomputer-Based Design", Peatman, John B., 1977, 214-219, 229-231, 274-299.

"Owner's Guide Kroy Lettering Machines", Part Number 1285500.

"HyTerm Communications Terminal Model 1610/1620 Maintenance Manual", Diablo Systems, Inc., Dec. 1978.

"Spinwriter Theory of Operation Manual, NEC Information Systems, Inc., 1979.

"Step Motor Control of a Daisy Wheel Printer", Incremental Motion Control Syst., Soc., May 24-26, 1978, pp. 283-289.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 20 is confirmed.

Claims 1, 2, 5, 6, 14, 15, 19, 22, 24, 25, 27, 28, 30, 31, and 34–36 are determined to be patentable as amended.

Claims 3, 4, 7–13, 16–18, 21, 23, 26, 29, 32, and 33, dependent on an amended claim, are determined to be patentable.

1. In a tape lettering or printing apparatus for lettering or printing characters [on a] *longitudinally along a strip of* tape comprising a *stationary* tape printing station, a *rigid unitary* circular rotatable font for providing a raised character in printing alignment at the tape printing station and means for printing characters on the tape in a tape print cycle, including a means for providing a color carrying ribbon and image carrying tape *of substantially the same width* at the tape printing station, a means for advancing the ribbon and tape *for intercharacter spacing* in alignment with the tape printing station, and a force generating means for exerting a *high pressure* printing force to print characters on the tape at the tape printing station, and wherein the means for printing characters on the tape further comprises a print motor for operating the tape printing apparatus during the tape print cycle, the improvement comprising:

processing means for receiving input data to be printed on the tape and for supplying control signals to the tape printing apparatus to *control the printing of characters on the tape and* cause the tape printing apparatus to print the input data on the tape;

data input means connected to the processing means for *manually* entering input data and transmitting the data in encoded form to the processing means so that the data can be sequentially printed on the tape;

a character positioning motor, operatively connected to the circular rotatable font, for rotating the circular font to provide a raised character at the tape printing station;

character positioning motor control means for causing, in response to [receipt of] control signals from the processing means, the character positioning motor to rotate and position the font from its present position to a selected character position so that a selected character to be printed on the tape is presented at the tape printing station;

means for deenergizing the character positioning motor prior to aligning the character to be printed on the tape;

print motor control means for causing, in response to control signals from the processing means, the tape print cycle to occur so that the color carrying ribbon and image carrying tape are provided at the tape printing station, the selected character to be printed on the tape is aligned for printing and a printing force is exerted against the color carrying ribbon, the tape and the character on the circular font at the tape printing station so that an image of the character is transferred from the color carrying ribbon to the image carrying tape; and means enabling the simultaneous *and continuous* entry and printing of data and permitting the rate of *manual* data entry to exceed the rate of *tape* printing, said enabling means including the processing means which comprises:

a multiple character input buffer for receiving *and storing* coded data from the input means at the *manual input* data rate of the input means;

a programmed microcomputer for *continuously and* sequentially decoding the data in the input buffer and for calculating the amount of rotation of the circular rotatable font necessary to sequentially print each successive character on the tape;

an output buffer connected to and controlled by the programmed microcomputer and connected to control with control signals the character positioning motor through the character positioning motor control means and the print motor through the print motor control means in the sequence programmed into the microcomputer so that each character on the circular rotatable font corresponding to a character entered by the data input means is sequentially positioned at the tape printing station and a tape print cycle is initiated and concluded for each character so that data can be printed on the tape at the printing rate of the tape printing apparatus and subsequent data can be simultaneously entered into said input buffer; and wherein the character positioning motor control means and the print motor control means each comprise means for converting the logic level signals of the processing means into power level signals sufficient to operate the character positioning motor and the print motor, respectively.

2. The improvement of claim 1 wherein the processing means comprises a programmable, digital processing means having memory means for storing input data to be printed on the tape and control information, the control information including a stored program for directing control functions to be performed, and wherein the programmable, digital processing means is connected to the character positioning motor control means and the print motor control means for supplying control signals to *control* the tape printing apparatus as a function of the control information.

5. The improvement of claim 3 wherein the circular font for providing a raised character for printing on the tape at the tape printing station comprises a removable disc so that a plurality of different styles or sizes of characters can be selectively printed on the tape by the tape printing apparatus and wherein the keyboard further comprises a plurality of removable panels to be inserted over the keys of the keyboard, *each panel having apertures therein corresponding to the key locations and* each panel having indicia subscribed thereon which corresponds to characters on the selected removable disc whereby the keyboard can be adapted to correspond to the selected removable disc mounted on the tape printing apparatus.

6. The improvement of claim 2 further comprising:

an audible transducer for emitting an audible signal;

audible alarm control means for causing, in response to control signals from the digital processing means, the audible transducer to emit a warning sound *for the operator* when [the buffer has been filled to] a selected number of characters to be printed on the tape *have been entered into the multiple character buffer, the selected number of characters being less than the full capacity of the buffer*; and wherein the programmable, digital processing means comprises means for keeping track of the number of characters entered into the multiple character buffer and means for providing a control signal to the audible alarm control means when [a] *the* selected number of characters to be printed on the tape have been entered into the multiple character buffer *so that characters will not be lost from the buffer.*

14. The improvement of claim 2 wherein the tape printing apparatus can be operable or nonoperable and when operable can be operated in different modes of operation and wherein the programmable, digital processing means comprises means for monitoring the operational status of the tape printing apparatus and wherein the improvement further comprises means for visually displaying the operational status *and selected modes of operation* of the tape printing apparatus.

15. The improvement of claim 14 wherein the means for visually displaying the operational status *and modes of operation* of the tape printing apparatus comprises:

a plurality of LED's mounted on the means for entering input data whereby the operational status *and mode of operation* of the tape printing apparatus can be visually observed while entering data to be printed on the tape.

19. The improvement of claim 1 wherein the improvement further comprises means for enhancing the quality of lettering by automatically controlling the spacing [between] *to kern* certain *preselected* combinations of [individual] printed characters.

22. The improvement of claim 2 wherein data to be printed on the tape is entered in message units and wherein the improvement further comprises means for editing the message to be printed on the tape *before it is printed.*

24. The improvement of claim 23 wherein the data to be printed on the tape is stored in [a] *the* multiple character buffer and wherein the function key operates to delete the previous message unit *entered from the input keyboard* from the multiple character buffer.

25. The improvement of claim 22 wherein the improvement further comprises *means for producing a plurality of identical tapes based on one set of input data and* and means for displaying the message to be printed on the tape *before the plurality of tapes is printed.*

27. [The improvement of claim 2] *In a tape letter or printing apparatus for lettering or printing characters on a tape comprising a tape printing station, a circular rotatable font for providing a raised character in printing alignment at the tape printing station and means for printing characters on the tape in a tape print cycle, including a means for providing a color carrying ribbon and image carrying tape at the tape printing station, a means for advancing the ribbon and tape in alignment with the tape printing station, and a force generating means for exerting a printing force to print characters on the tape printing station, and wherein the means for printing characters on the tape further comprises a print motor for operating the tape printing apparatus during the tape print cycle, the improvement comprising:*

*a programmable, digital processing means having memory means for receiving and storing input data to be printed on the tape and control information for supplying control signals to the tape printing apparatus to cause the tape printing apparatus to print the input data on the tape, the control information including a stored program for directing control functions to be performed;*

*data input means connected to the processing means for manually entering input data and transmitting the data in encoded form to the processing means so that the data can be sequentially printed on the tape;*

*a character positioning motor, operatively connected to the circular rotatable font, for rotating the circular font to provide a raised character at the tape printing station;*

*character positioning motor control means connected to the programmable, digital processing means for causing, in response to receipt of control signals supplied from the processing means as a function of the control information, the character positioning motor to rotate and position the font from its present position to a selected character position so that a selected character to be printed on the tape is presented at the tape printing station, the character positioning motor means comprising means for converting the logic level signals of the processing means into power level signals sufficient to operate the character positioning motor;*

*means for deenergizing the character positioning motor prior to aligning the character to be printed on the tape;*

*print motor control means connected to the programmable, digital processing means for causing, in response to control signals supplied from the processing means as a function of the control information, the tape print cycle to occur so that the color carrying ribbon and image carrying tape are provided at the tape printing station, the selected character to be printed on the tape is aligned for printing and a printing force is exerted against the color carrying ribbon, the tape and the character on the circular font at the tape printing station so that an image of the character is transferred from the color carrying ribbon to the image carrying tape, the print motor control means comprising means for converting the logic level signal of the processing means into power level signals sufficient to operate the print motor; and*

*means enabling the simultaneous and continuous entry and printing of data and permitting the rate of manual data entry to exceed the rate of tape printing, said enabling means including the processing means and the memory means which comprises:*

*a multiple character input buffer for receiving coded data from the input means at the manual input data rate;*

*a programmed microcomputer for continuously and sequentially decoding the data in the input buffer and for calculating the amount of rotation of the circular rotatable font necessary to sequentially print each successive character on the tape;*

*an output buffer connected to and controlled by the programmed microcomputer and connected to control with control signals the character positioning motor*

*through the character positioning motor control means and the print motor through the print motor control means in the sequence programmed into the microcomputer so that each character on the circular rotatable font corresponding to a character entered by the data input means is sequentially positioned at the tape printing station and a tape print cycle is initiated and concluded for each character so that data can be printed on the tape at the printing rate of the tape printing apparatus and subsequent data can be simultaneously entered into said input buffer; and* wherein the circular rotatable font for providing a raised character for printing at the tape printing station comprises a removable disc so that a plurality of different styles or sizes of characters can be selectively printed by the tape printing apparatus and wherein the control information comprises a plurality of tables stored by the programmable, digital processing means, each table corresponding to a selected type disc and wherein the means for entering data to be printed on the tape comprises at least one function key connected to the programmable, digital processing means, said function key corresponding to a selected type disc and table, and wherein the programmable, digital processing means comprises means for analyzing whether the function key has been depressed and means for causing control signals to be connected to the tape printing apparatus to print characters on the tape which correspond to the selected type disc.

28. The improvement of claim 7 wherein input data to be printed on the tape is stored in [a] *the* multiple character buffer and wherein one of the function keys comprises a function key *which causes the programmable, digital processing means* to selectively stop the tape printing apparatus from printing characters on the tape which are stored by the programmable, digital processing means in the multiple character buffer.

30. In a tape lettering or printing apparatus *for printing characters longitudinally along a strip of tape* comprising a *stationary* tape printing station, a *rigid, unitary* circular rotatable font for providing a raised character for printing on the tape at the tape printing station and means for printing a tape in a tape print cycle, including a means for providing a color carrying ribbon and image [carrying] *receiving* tape *of substantially the same width* at the tape printing station, a means for precisely aligning the raised character for printing on the tape at the tape printing station, a force generating means for exerting a *high pressure* printing force at the tape printing station *to force the tape and ribbon against the raised character*, and means for advancing the tape and ribbon *for intercharacter spacing* into printing alignment at the tape printing station, and wherein the means for printing a tape further comprises a print motor for operating the tape printing apparatus during the print cycle, the improvement comprising:

a programmable, digital processing means for storing input data to be printed on the tape and control information, the control information including a stored program for directing control functions to be performed and for supplying control signals to the tape printing apparatus as a function of the control information *to control the printing of the characters on the tape*;

means connected to the digital processing means for *manually* entering coded input data to be printed on the tape;

a character positioning motor, operatively connected to the circular rotatable font *and controlled by the processing means*, for positioning the font to provide a raised character to be printed on the tape at the tape printing station;

character positioning motor control means for causing, in response to receipt of control signals from the digital processing means, the character positioning motor to rotate and position the circular rotatable font from its present position to a selected character position so that a selected character to be printed on the tape is presented at the tape printing station; and print motor control means for causing, in response to control signals from the digital processing means, the tape print cycle to occur so that the ribbon and tape providing means provides the color carrying ribbon and image carrying tape at the tape printing station, the character aligning means precisely aligns the selected raised character to be printed on the tape at the tape printing station, the force generating means exerts a printing force at the tape printing station *to press the ribbon and tape against the raised character*, and the means for advancing the tape and ribbon advances the tape and ribbon into printing alignment at the tape printing station to receive the next character to be printed on the tape; and means enabling the simultaneous *and continuous* entry and printing of data and permitting the rate of *manual* data entry to exceed the rate of *tape* printing, said enabling means including the programmable digital processing means which comprises:

a multiple character input buffer for receiving *and storing* coded data from the input means at the *manual input* data rate of the input means;

a programmed microcomputer for *continuously and* sequentially decoding the data *stored* in the input buffer and for calculating the amount of rotation of the circular rotatable font necessary to sequentially print each successive character on the tape;

an output buffer connected to and controlled by the programmed microcomputer and connected to control with control signals the character positioning motor through the character positioning motor control means and the print motor through the print motor control means in the sequence programmed into the microcomputer so that each character on the circular rotatable font corresponding to a character entered by the data input means is sequentially positioned at the tape printing station and a tape print cycle is initiated and concluded for each character so that the data is printed on the tape at the printing rate of the tape printing apparatus and subsequent data can be *continuously and* simultaneously entered into said input buffer; and wherein the character positioning motor control means and the print motor control means each comprise means for converting the logic level signals of the microcomputer into power level signals sufficient to operate the character positioning motor and the print motor, respectively.

31. In a tape lettering or printing apparatus *for printing characters longitudinally along a tape* comprising a *stationary* tape printing station, a *rigid unitary* circular rotatable font for providing a raised character for printing on the tape at the tape printing station and means for printing a tape in a tape print cycle, including a means for providing a color carrying ribbon and image [carrying] *receiving* tape *of substantially the same width* at the tape printing station, a means for precisely aligning the raised character for printing on the tape at the tape printing station, a force generating means for exerting a *high pressure* printing force at the tape printing station, and means for advancing the tape and ribbon *for inter-character spacing* into printing alignment at the tape printing station, and wherein the means for printing a tape further comprises a print motor for operating the tape printing apparatus during the print cycle, *the tape lettering apparatus being capable of operation in various modes of operation,* the inprovement comprising:

a programmable, digital processing means for storing input data to be printed on the tape and control information, the control information including a stored program for directing control functions to be performed and for supplying control signals to the tape printing apparatus as a function of the control information *to control the printing of the characters on the tape;* means connected to the digital processing means for *manually* entering input data to be printed on the tape;

a character positioning motor, operatively connected to the circular rotatable font, for positioning the font to provide a raised character to be printed on the tape at the tape printing station;

character positioning motor control means for causing, in response to receipt of control signals from the digital processing means, the character positioning motor to rotate and position the circular rotatable font from its present position to a selected character position so that a selected character to be printed on the tape is presented at the tape printing station;

print motor control means for causing, in response to control signals from the digital processing means, the tape print cycle to occur so that the ribbon and tape providing means provides the color carrying ribbon and image carrying tape at the tape printing station, the character aligning means precisely aligns the selected raised character to be printed on the tape at the tape printing station, the force generating means exerts a printing force at the tape printing station *to press the ribbon and the tape against the raised characters,* and the means for advancing the tape and ribbon advances the tape and ribbon into printing alignment at the tape printing station to receive the next character to be printed on the tape;

visual display means *mounted on the data input means* connected to the programmable digital processing means for visually displaying the operational status *and mode of operation* of the tape printing apparatus;

sensing means for optically sensing the position of the circular rotatable font, connected to the programmable processing means, so that at least one of the control signals from the digital processing means to the character positioning motor is a function of the position of the circular rotatable font as sensed by the optical sensing means;

software means to cause the programmable digital processing means to emit a control signal to the character positioning motor control means to automatically position the circular rotatable font to a designated home position;

kerning means connected to the means for providing a color carrying ribbon and image carrying tape at the tape printing station for enhancing the quality of lettering by automatically [controlling the spacing between] *kerning* certain combinations of individual characters printed on the tape; and wherein the means for entering input data to be printed on the tape further comprises a plurality of function keys connected to the programmable, digital processing means, each function key corresponding to a selected function of the tape printing apparatus, and wherein the programmable, digital processing means comprises software means as part of the control information for analyzing which function key has been depressed and means for causing control signals to be connected to the tape printing apparatus to execute the selected function corresponding to the selected function key *and to issue control signals to the visual display means to indicate selection of certain of the functions.*

34. An input and control device for a tape printing machine having a [rotatable character font mounted on top of the machine for printing a single line of characters on a tape], *stationary print station past which a narrow color carrying ribbon and a strip of image receiving tape is advanced, the ribbon and tape being substantially the same width and continuous in length, the width being sufficient to receive a line of lettered characters, the lettering being transferred from the colored ribbon to the tape by a high pressure motor controlled force mechanism which presses the tape and ribbon against characters projecting toward the force generating means from a rotatable rigid unitary font which is rotatably secured at the print station so that the character to be printed is aligned for printing at the print station, the movement of the tape and ribbon past the stationary print station being controlled for inter-character spacing so that characters are sequentially transferred from the ribbon onto the narrow tape longitudinally along the tape* comprising:

an input keyboard to *manually* enter characters to be printed on the tape;

a multiple character data buffer memory means for *receiving the characters entered on the input keyboard and* storing the sequence of characters to be printed on the tape *until the characters can be sequentially printed at the print station in the same order that the characters have been entered at the keyboard* [typed on the input keyboard];

a computer program for determining which keys on the keyboard have been depressed and for determining the sequence of movement for the character font so that the sequence of characters that have been stored in the data buffer will be printed on the tape;

a second memory means for storing the computer program;

a digital microprocessor connected to the memory means and the tape printing machine and controlled by the computer program for calculating the amount of rotation of the circular rotatable font necessary to *continuously and* sequentially print each successive character on the tape and for issuing control signals to cause the sequence of characters stored in the data buffer to be *continuously and* sequentially printed in a single line on the tape by the tape printing machine;

a motor electrically connected to *and controlled by* the microprocessor and operatively connected to the character font for sequentially rotating the character font to the sequence of characters in the data buffer for purposes of printing the characters on the tape;

motor control means electrically connecting the motor and the digital microprocessor; and means enabling the simultaneous *and continuous* entry and printing of data and permitting the rate of data entry to exceed the rate of printing, said enabling means including an output buffer connected to and controlled by the digital microprocessor and connected to control with control signals the motor through the motor control means in the sequence programmed into the microprocessor so that each character on the rotatable character font corresponding to a character entered on the input keyboard is sequentially positioned and a tape print cycle is initiated and concluded for each character so that the characters are printed on the tape at the printing rate of the tape printing machine and subsequent data can be *continuously and* simultaneously entered into said data buffer; and wherein the motor control means comprises means for converting the logic level signals of the microprocessor into power level signals sufficient to operate *and control* the motor.

35. An automated tape lettering machine for printing a line of characters on a tape, comprising:

an input keyboard to enter characters to be printed on the tape;

a multiple character data buffer memory for *receiving and* storing the sequence of characters entered on the input keyboard so that characters can be entered at a faster rate than the characters are printed on the tape;

a rotatable and selectively removable *rigid unitary* character font mounted on the tape lettering machine, the character font having a plurality of raised characters thereon corresponding to the characters on the input keyboard;

a programmed microcomputer for determining which keys on the keyboard have been depressed, for storing the characters in the data buffer, for determining which characters remain in the data buffer to be printed on the tape, for calculating the amount of rotation of the circular rotatable font necessary to sequentially print each successive character on the tape, and for controlling the sequence of movement of the character font so that the sequence of characters stored in the data buffer is *continuously and* sequentially printed on the tape;

a *stationary* tape printing station for printing characters on the tape;

means for providing a tape to be printed at the printing station and a color carrying ribbon to print characters on tape, *the ribbon and the tape being substantially the same width and continuous in length, the movement of the tape and ribbon past the print station being controlled for intercharacter spacing so that characters are printed longitudinally along the tape*;

a character positioning motor electrically connected to and controlled by the microcomputer and operatively connected to the character font for sequentially rotating the character font to the sequence of characters in the data buffer;

character positioning motor control means connected to the microcomputer and the character positioning motor;

*a high pressure* force generating means electrically connected to and controlled by the microcomputer for exerting a *motor driven* printing force *against the characters projecting from the character font* at the tape printing station to transfer the raised character image on the character font from the color carrying ribbon to the tape being printed;

force generating control means connected to the microcomputer and the force generating means;

means enabling the simultaneous *and continuous* entry and printing of data and permitting the rate of data entry to exceed the rate of printing, said enabling means including:

an output buffer connected to and controlled by the programmed microcomputer and connected to control with control signals the character positioning motor through the character positioning motor control means and the force generating means through the force generating control means in the sequence programmed into the microcomputer so that each character on the circular rotatable font corresponding to a character entered [by the data input means] *on the input keyboard* is sequentially positioned at the tape printing station and a tape print cycle is initiated and concluded for each character so that the data is printed on the tape at the printing rate of the tape lettering machine and subsequent data can be *continuously and* simultaneously entered into said data buffer; and wherein the character positioning motor control means and the force generating control means each comprise means for converting the logic level signals of the microcomputer into power level signals sufficient to operate the character positioning motor and the force generating means, respectively.

36. A keyboard actuated tape lettering or printing apparatus having a tape printing station for printing a line of characters on a tape comprising:

an input keyboard having a plurality of keys, each with a character thereon;

a programmed microprocessor connected to the keyboard to cause characters *manually* entered on the keyboard to be printed on the tape;

a rotatable font having a plurality of raised characters thereon for providing a raised character in printing alignment at said tape printing station;

a motor electrically connected to and controlled by the microprocessor and operatively connected to the rotatable font to rotate the correct raised character to the tape printing station;

means for providing a color carrying ribbon and an image carrying tape at said tape printing station, said ribbon and tape providing means comprising:

advancement means for advancing said ribbon and tape into printing alignment at said tape printing station, said advancement means including a cartridge carrier movable reciprovally toward and away from said tape printing station;

a tape-ribbon cartridge containing a supply of ribbon and tape adapted for insertion into said cartridge carrier for movement therewith forward and away from said tape printing station; and force generating means connected to and controlled by said microprocessor for exerting a printing force at said tape printing station to transfer an image of said raised character from said ribbon to said tape; and means enabling the simultaneous *and continuous* entry and printing of data and permitting the rate of *manual* data entry *on the keyboard* to exceed the rate of *tape* printing, said enabling means including the programmed microprocessor which comprises:

a multiple character input buffer for receiving coded data from the input keyboard at the data rate of the operator;

a programmed microcomputer for *continuously and* sequentially decoding the data in the input buffer and for calculating the amount of rotation of the rotatable font necessary to sequentially print each successive character on the tape;

an output buffer connected to and controlled by the programmed microcomputer and connected to control with control signals the motor and the force generating means in the sequence programmed into the microcomputer so that each character on the circular rotatable font corresponding to a character entered by the data input means is sequentially positioned at the tape printing station and a tape print cycle is initiated and concluded for each character so that the data is printed on the tape at the printing rate of the tape printing apparatus and subsequent data can be *continuously and* simultaneously entered into said input buffer; and means for converting the logic level signals of the microprocessor into power level signals sufficient to operate the motor and the force generating means, respectively.

* * * * *